US008718519B2

(12) United States Patent
Nakashima

(10) Patent No.: US 8,718,519 B2
(45) Date of Patent: May 6, 2014

(54) IMAGE FORMING APPARATUS AND METHOD OF CONTROLLING THE SAME

(75) Inventor: Satoshi Nakashima, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 217 days.

(21) Appl. No.: 13/311,028

(22) Filed: Dec. 5, 2011

(65) Prior Publication Data

US 2012/0148315 A1 Jun. 14, 2012

(30) Foreign Application Priority Data

Dec. 14, 2010 (JP) ..... 2010-278393

(51) Int. Cl.
*G03G 15/01* (2006.01)

(52) U.S. Cl.
USPC ..... 399/301

(58) Field of Classification Search
USPC ..... 399/301
See application file for complete search history.

(56) References Cited

U.S. PATENT DOCUMENTS

2010/0178084 A1* 7/2010 Kang et al. ..... 399/301
2010/0278560 A1 11/2010 Ino et al.

FOREIGN PATENT DOCUMENTS

JP 2001-356542 A 12/2001
JP 2005-316510 A 11/2005

* cited by examiner

*Primary Examiner* — Walter L Lindsay, Jr.
*Assistant Examiner* — Barnabas Fekete
(74) *Attorney, Agent, or Firm* — Fitzpatrick, Cella, Harper & Scinto

(57) ABSTRACT

An image forming apparatus transfers pattern images for color deviation detection of the respective colors on an endless belt, and corrects color deviation occurring when each image forming unit forms an image on a recording material, in accordance with the amount of color deviation detected by a registration detection sensor. The image forming apparatus forms pattern images of the respective colors on the endless belt at the intervals determined based on the total variation obtained by totaling each variation of the transfer and detection positions of a pattern image of each color on the endless belt from an ideal position. This enables to reduce color deviation detection errors by using pattern images for color deviation detection and improve the accuracy of color deviation correction.

17 Claims, 19 Drawing Sheets

FIG. 10

| | TRANSFER TIME | DETECTION TIME |
|---|---|---|
| K (REFERENCE COLOR) | tK | tK + R / V |
| Y | tY | tY + (R + SY) / V |
| M | tM | tM + (R + SM) / V |
| C | tC | tC + (R + SC) / V |

IMAGE FORMING APPARATUS AND METHOD OF CONTROLLING THE SAME

BACKGROUND OF THE INVENTION

1. Field of the Invention

The present invention relates to an image forming apparatus and a method of controlling the same.

2. Description of the Related Art

An electrophotographic type color image forming apparatus generally includes a plurality of image forming units corresponding to different development colors. The respective image forming units form toner images of the respective development colors on photosensitive drums. In addition, the image forming apparatus forms a color image on a recording material held on a conveyance belt by sequentially superimposing and transferring the toner images of the respective colors, formed on the respective photosensitive drums, at the same position on the recording material. Alternatively, when the image forming apparatus includes an intermediate transfer belt, the apparatus forms a color image on the intermediate transfer belt by sequentially superimposing and transferring the toner images of the respective colors, formed on the respective photosensitive drums, at the same position on the intermediate transfer belt. Thereafter, the image forming apparatus forms a color image on the recording material by transferring the color image, formed on the intermediate transfer belt, onto the recording material (a case in which the image forming apparatus includes no intermediate transfer belt will be described below).

In such an image forming apparatus, the positions of toner images of the respective colors transferred from the photosensitive drums onto a recording material may differ from each other on the recording material, resulting in positional deviation (to be also referred to as "color deviation" hereinafter) due to the transfer of the respective toner images at positions different from each other. This color deviation can occur due to, for example, the unevenness of rotation of the respective photosensitive drums, the unevenness of movement of the conveyance belt, and fluctuations in the relative moving amounts between the outer surfaces of the photosensitive drums and the conveyance belt at the transfer positions of the respective image forming units for the respective colors. Particularly, in an image forming apparatus constituted by a plurality of image forming units each including a laser scanner and a photosensitive drum, if the distances between the laser scanners and the photosensitive drums in the respective image forming units differ from each other, the scanning widths of the lasers on the photosensitive drums fluctuate for the respective image forming units. This may cause color deviation.

As a technique for reducing such color deviation, there is known a technique of forming pattern images for color deviation detection, for the respective colors, on the conveyance belt which moves at a predetermined speed, and correcting color deviation based on the detection results obtained by detecting the respective pattern images using sensors provided on the downstream side. For example, speed fluctuations (unevenness of speed) of a long period equal to the rotation period of the conveyance belt occur in the conveying (moving) speed of the conveyance belt due to the unevenness of thickness of the conveyance belt. In addition, the moving speed of the peripheral surface of the conveyance belt may fluctuate due to rotating speed fluctuations occurring in the driving roller which drives the conveyance belt. In such a case, owing to the moving speed fluctuations of the peripheral surface of the conveyance belt, the transfer position to which a color deviation detection pattern image is transferred and the detection position where a pattern image is detected from the conveyance belt may change on the conveyance belt. This causes an error in the color deviation detection result obtained by using a color deviation detection pattern image. When such a color deviation detection error occurs, the accuracy of color deviation correction deteriorates, and the quality of an image formed on a recording material deteriorates.

To solve the above problems, for example, Japanese Patent Laid-Open Nos. 2001-356542 and 2005-316510 have proposed techniques. According to Japanese Patent Laid-Open No. 2001-356542, a plurality of detection pattern images are arranged at intervals corresponding to a fraction of an integer of the period on the conveyance belt in correspondence with speed fluctuation components in a specific period which cause color deviation detection errors. In addition, this technique reduces detection errors by averaging detection values obtained from the conveyance belt. Furthermore, the technique in Japanese Patent Laid-Open No. 2005-316510 reduces the influences of detection errors due to the moving speed fluctuations of the peripheral surface occurring at the same period as the rotation period of the conveyance belt, which can occur at the time of transfer of pattern images, by matching the transfer timings of color deviation detection pattern images with the transfer timings for all the colors.

The above conventional techniques, however, have the following problems. For example, according to Japanese Patent Laid-Open No. 2001-356542, when there are speed fluctuation components of a plurality of periods as speed fluctuation components whose influences should be removed, an attempt to reduce color deviation detection errors due to all the speed fluctuation components will increase the lengths of pattern images to be formed on the conveyance belt. This also increase the time required to detect the formed pattern images. In addition, in order to cope with speed fluctuations of a long period such as the period of the conveyance belt, it is necessary to form detection pattern images throughout the peripheral length of the conveyance belt, resulting in a large number of pattern images to be formed. This leads to an increase in the amount of toner consumed to form a detection pattern image.

The technique disclosed in Japanese Patent Laid-Open No. 2005-316510 gives consideration to detection errors occurring at the time of pattern image transfer as color deviation detection errors by the above speed fluctuations when using detection pattern images. On the other hand, the technique gives no consideration to detection errors occurring at the time of detection of pattern images. That is, according to the technique disclosed in Japanese Patent Laid-Open No. 2005-316510, matching the transfer timings of detection pattern images of all the colors with each other will match the magnitudes of the moving speed fluctuations of the peripheral surface of the conveyance belt at the transfer timings for all the colors. This can reduce color deviation detection errors. On the other hand, since different detection timings are set for detection pattern images of the respective colors, speed fluctuations of different magnitudes occur in the moving speed of the peripheral surface of the conveyance belt at the detection timings of the respective colors. As a result, detection errors due to fluctuations in the detection timings of detection pattern images for the respective colors remain in color deviation detection errors.

SUMMARY OF THE INVENTION

The present invention has been made in consideration of the above problems, and provides an image forming apparatus which reduces color deviation detection errors using color deviation detection pattern images and improves the accuracy of color deviation correction, and a method of controlling the same.

According to one aspect of the present invention, there is provided an image forming apparatus including an endless belt for formation of an image, a plurality of imaging forming units that are provided at positions different from each other along a moving direction of a peripheral surface of the endless belt and form images of different colors on the endless belt, and a sensor provided at a position on a downstream side relative to the plurality of image forming units along the moving direction of the peripheral surface of the endless belt, the apparatus comprising: a pattern forming unit that forms a plurality of pattern images of different colors at predetermined intervals on the endless belt by using the plurality of image forming units, the plurality of pattern images of the different colors being used to calculate an amount of color deviation when a plurality of images of different colors are superimposed and formed on the endless belt; a detection unit that detects, using the sensor, the plurality of pattern images formed on the endless belt by the pattern forming unit; a calculation unit that calculates the amount of color deviation from detection results on the plurality of pattern images which are obtained by the detection unit; and a correction unit that corrects color deviation in accordance with the amount of color deviation calculated by the calculation unit, wherein the pattern forming unit forms the plurality of pattern images on the endless belt by using the plurality of image forming units at first intervals which reduce, to a predetermined allowable range, a total variation of a variation of a formation position where the pattern image is formed by the image forming unit on the endless belt with respect to an ideal position and a variation of a detection position where the sensor detects the pattern image with respect to an ideal position, the variations occurring when a moving speed of the peripheral surface of the endless belt fluctuates at a specific period.

According to another aspect of the present invention, there is provided a method of controlling an image forming apparatus including an endless belt for formation of an image, a plurality of imaging forming units that are provided at positions different from each other along a moving direction of a peripheral surface of the endless belt and form images of different colors on the endless belt, and a sensor provided at a position on a downstream side relative to the plurality of image forming units along the moving direction of the peripheral surface of the endless belt, the method comprising: forming a plurality of pattern images of different colors at predetermined intervals on the endless belt by using the plurality of image forming units, the plurality of pattern images of the different colors being used to calculate an amount of color deviation when a plurality of images of different colors are superimposed and formed on the endless belt; detecting, using the sensor, the plurality of pattern images formed on the endless belt in the forming; calculating the amount of color deviation from detection results on the plurality of pattern images which are obtained in the detecting; and correcting color deviation in accordance with the amount of color deviation calculated in the calculating, wherein in the forming, the plurality of pattern images are formed on the endless belt by using the plurality of image forming units at first intervals which reduce, to a predetermined allowable range, a total variation of a variation of a formation position where the pattern image is formed by the image forming unit on the endless belt with respect to an ideal position and a variation of a detection position where the sensor detects the pattern image with respect to an ideal position, the variations occurring when a moving speed of the peripheral surface of the endless belt fluctuates at a specific period.

The present invention can provide an image forming apparatus which reduces color deviation detection errors by using color deviation detection pattern images and improves the accuracy of color deviation correction, and a method of controlling the same.

Further features of the present invention will become apparent from the following description of exemplary embodiments (with reference to the attached drawings).

BRIEF DESCRIPTION OF THE DRAWINGS

FIG. 10 is a view showing the relationship between transfer timings and detection timings concerning pattern images of the respective colors in the image forming apparatus according to the first embodiment;

DESCRIPTION OF THE EMBODIMENTS

Hereinafter, embodiments of the present invention will be described in detail with reference to the accompanying drawings. It should be noted that the following embodiments are not intended to limit the scope of the appended claims, and that not all the combinations of features described in the embodiments are essential to the solving means of the present invention.

First Embodiment

The first embodiment of the present invention will be described below. This embodiment will exemplify, as an example of an image forming apparatus according to the present invention, a case in which the present invention is applied to an electrophotographic type color image forming apparatus (printing apparatus).

<Arrangement of Image Forming Apparatus>

Figure 1:
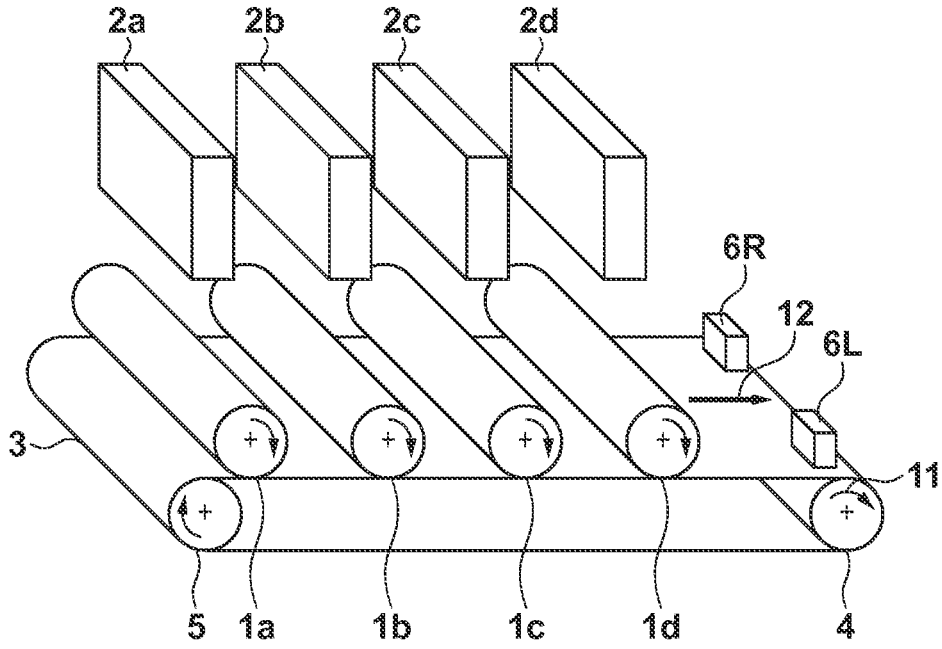
FIG. 1 is a perspective view showing the schematic arrangement of an image forming apparatus according to the first embodiment.

The color image forming apparatus shown in FIG. 1 includes a plurality of image forming units respectively corresponding to the four colors of cyan (C), magenta (M), yellow (Y), and black (K). The respective image forming units respectively include photosensitive drums 1*a*, 1*b*, 1*c*, and 1*d* and laser scanners 2*a*, 2*b*, 2*c*, and 2*d* which respectively expose the photosensitive drums 1*a*, 1*b*, 1*c*, and 1*d* in accordance with an input image signal and form electrostatic latent images on the surfaces of the photosensitive drums 1*a*, 1*b*, 1*c*, and 1*d*. The image forming apparatus further includes a conveyance belt 3 as an endless belt which conveys a sheet fed from a paper cassette (not shown) to each image forming unit. A driving roller 4 which rotates in the direction indicted by an arrow 11 drives the conveyance belt 3. This makes the conveyance belt 3 convey a sheet while moving in the direction indicated by an arrow 12. A driven roller 5 rotates as the conveyance belt 3 moves, and applies a predetermined tensile force to the conveyance belt 3. In this case, the plurality of image forming units are provided at positions different from each other along the moving direction of the peripheral surface of the conveyance belt 3. A pair of registration detection sensors 6L and 6R which detect pattern images for color deviation detection formed on the conveyance belt 3 are arranged above the conveyance belt 3. The registration detection sensors 6L and 6R are arranged side by side above the conveyance belt 3 in a direction perpendicular to the conveyance (moving) direction.

Upon receiving image data for printing from an image reading unit (not shown) such as an external PC or scanner, the image forming apparatus starts preparation operation for image formation. When the apparatus becomes ready for printing upon this preparation operation, the apparatus sends image signals generated based on image data corresponding to the respective colors to the laser scanners 2*a*, 2*b*, 2*c*, and 2*d*. The laser scanners 2*a*, 2*b*, 2*c*, and 2*d* respectively expose the photosensitive drums 1*a*, 1*b*, 1*c*, and 1*d* to form electrostatic latent images on the photosensitive drums 1*a*, 1*b*, 1*c*, and 1*d*. Developing devices (not shown) develop the respective electrostatic latent images formed on the photosensitive drums 1*a*, 1*b*, 1*c*, and 1*d* by using developing materials (toners) of the respective colors. The developed toner images are conveyed to transfer positions between the photosensitive drums 1*a*, 1*b*, 1*c*, and 1*d* and the conveyance belt 3 as the respective drums rotate.

A sheet is fed from the paper cassette onto the conveyance belt 3 in accordance with above image formation timing, and the sheet on the conveyance belt 3 is conveyed toward each image forming unit. The respective toner images formed on the photosensitive drums 1*a*, 1*b*, 1*c*, and 1*d* are sequentially superimposed and transferred on the sheet on the conveyance belt 3 at the respective transfer positions. After the transfer processing, the sheet on the conveyance belt 3 is conveyed to a fixing unit (not shown), which fixes the toner images on the sheet with heat and pressure. Thereafter, the sheet is discharged out of the apparatus.

(Arrangement and Operation of Registration Detection Sensor 6)

Figure 2A:
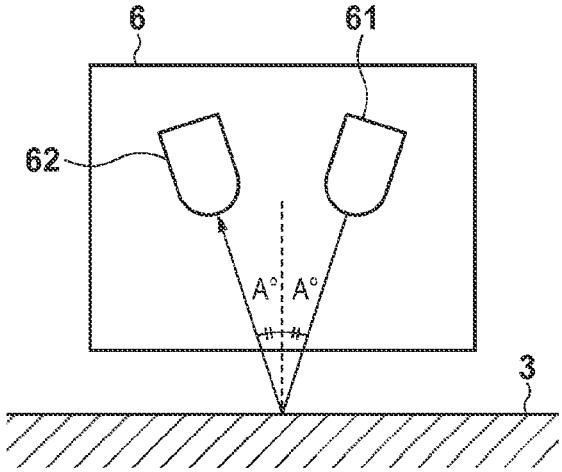
FIG. 2A is a view showing the arrangement of registration detection sensors 6L and 6R according to the first embodiment.

The registration detection sensors 6L and 6R shown in FIG. 1 each have the arrangement shown in FIG. 2A. Note that since the registration detection sensors 6L and 6R have the same arrangement, the suffixes L and R indicating the respective registration detection sensors are omitted in FIG. 2A. The registration detection sensor 6 includes an LED 61 which irradiates the conveyance belt 3 with light and a phototransistor (PTR) 62 which detects reflected light from the conveyance belt 3. The LED 61 is configured to irradiate a detection surface on the conveyance belt 3 with light at a predetermined angle A relative to the normal direction of the detection surface by using a lightguide and the like. In addition, as shown in FIG. 2A, the LED 61 and the PTR 62 are arranged to be optically symmetrical to each other. The light emitted from the LED 61 is regularly reflected by the surface of the conveyance belt 3 and received by the PTR 62. Although this embodiment includes, as the PTR 62, a sensor which detects regularly reflected light from the conveyance belt 3, it is possible to further include a phototransistor which detects irregularly reflected light from the conveyance belt 3.

Figure 2B:
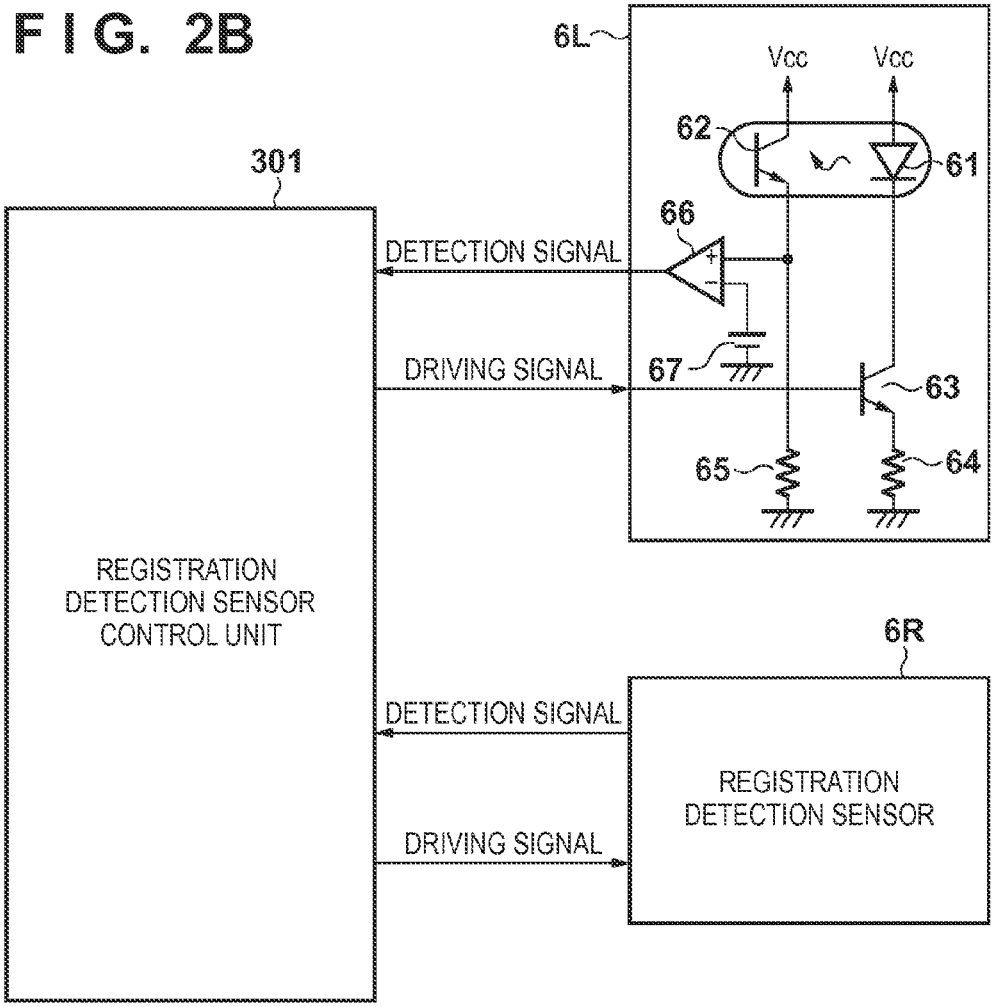
FIG. 2B is a view showing the schematic circuit arrangement and control arrangement of the registration detection sensors 6L and 6R according to the first embodiment.

The schematic circuit arrangement of each of the registration detection sensors 6L and 6R will be described next with reference to FIG. 2B. FIG. 2B shows the internal circuit arrangement of only the registration detection sensor 6L. However, the registration detection sensor 6R has the same circuit arrangement. The registration detection sensor 6L includes, in addition to the LED 61 and the PTR 62, a transistor 63 for turning on/off the LED 61, a resistor 64 for limiting a current flowing in the LED 61, a resistor 65 for converting a photocurrent in the PTR 62 into a photovoltage. In addition, the registration detection sensor 6L includes a comparator 66 which outputs the detection signal obtained by binarizing the voltage converted by the resistor 65 and a power supply 67 for a threshold voltage for the comparator 66.

A registration detection sensor control unit 301 outputs a driving signal for turning on/off the LED 61 to the registration detection sensor 6L. When the registration detection sensor control unit 301 outputs a driving signal for turning on the LED 61, the transistor 63 is turned on, and the LED 61 emits light. Upon receiving light emitted from the LED 61 and regularly reflected by the conveyance belt 3, the PTR 62 generates a photocurrent. The comparator 66 receives the photocurrent. The comparator 66 compares the photovoltage converted by the resistor 65 with the threshold voltage supplied from the power supply 67. If the photovoltage is lower than the threshold voltage, the comparator 66 outputs a High-level signal as a detection signal to the registration detection sensor control unit 301. If the photovoltage is higher than or equal to the threshold voltage, the comparator 66 outputs a Low-level signal as a detection signal to the registration detection sensor control unit 301. Note that a High-level signal as a detection signal indicates that a detection pattern image formed on the conveyance belt 3 is detected, whereas a Low-level signal as a detection signal indicates that no detection pattern image is detected.

The registration detection sensor control unit 301 further measures the output times of the detection signals output from the registration detection sensors 6L and 6R. In addition, the registration detection sensor control unit 301 calculates a color deviation value indicating positional deviation when toner images of the respective colors are superimposed, based on the measurement results of the registration detection sensors 6L and 6R. The registration detection sensor control unit 301 calculates a correction amount in each correction processing (to be described below) based on the calculation results on the color deviation values.

<Example of Color Deviation>

Figure 3:
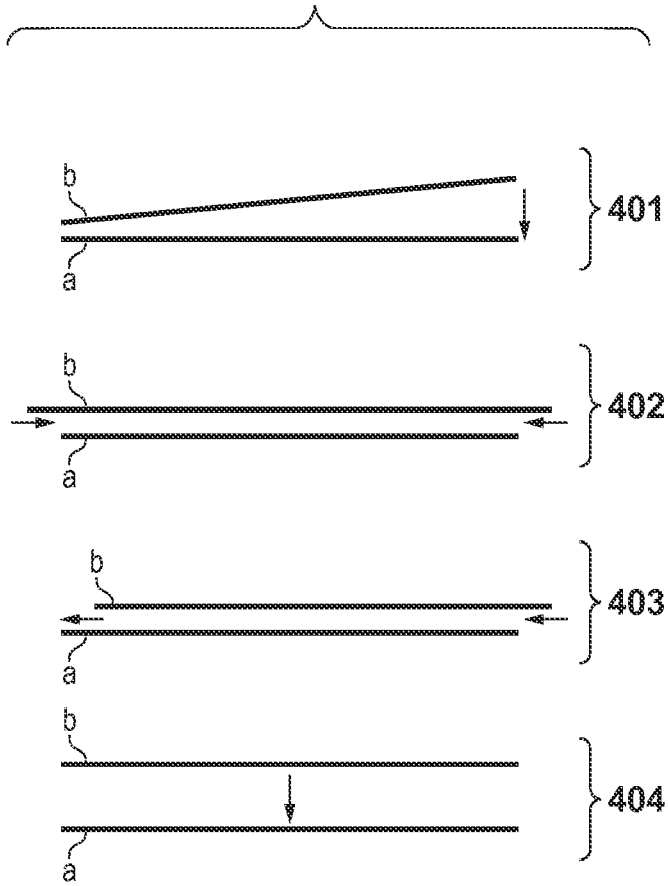
FIG. 3 is a view showing an example of color deviation which can occur in an image formed by the image forming apparatus.

FIG. 3 is a view showing an example of color deviation which can occur in an image formed by the image forming apparatus. FIG. 3 shows image positions on a sheet when a I-line (main scanning line) image is formed on the sheet. Referring to FIG. 3, reference numerals 401 and 404 denote cases in which color deviation is occurring in the sub-scanning direction; and 402 and 403, cases in which color deviation is occurring in the main scanning direction. In the cases 401 to 404, reference symbol a denotes an ideal image position where no color deviation is occurring; and b, an image position where color deviation has occurred with respect to the image indicated by a. In the cases 402 and 403, although no color deviation is occurring in the sub-scanning direction, lines a and b are drawn apart from each other in the sub-scanning direction for the sake of descriptive convenience. Note that the arrows shown in FIG. 3 indicate how the occurring color deviations should be corrected.

Reference numeral 401 denotes color deviation which has occurred when the sub-scanning direction tilts relative to a main scanning line. For example, this color deviation occurs when an optical unit, which scans the photosensitive drum with a laser beam, tilts relative to the photosensitive drum. In this case, it is possible to correct the main scanning line in the arrow direction by adjusting the positions of the optical unit, photosensitive drum, lens, and the like. Reference numeral 404 denotes a case in which an error has occurred in the write start position in the sub-scanning direction. In this case, it is possible to correct the main scanning line in the arrow direction by adjusting the time interval from the detection timing of the leading end of a sheet under conveyance to the write start timing of an image of each color.

Reference numeral 402 denotes color deviation when an error has occurred in the main scanning line width (overall magnification). For example, this error occurs depending on the differences in the distances between the optical units and the photosensitive drums in a plurality of image forming units. This error tends to occur when each optical unit is a laser scanner as in this embodiment. In this case, it is possible to correct the scanning line width in the arrow direction by finely adjusting an image frequency (increasing the frequency when the scanning line width is long). Reference numeral 403 denotes color deviation when an error has occurred in a write start position in the main scanning direction. In this case, if each optical unit is a laser scanner, it is possible to correct the main scanning line in the arrow direction by adjusting the time interval from the beam detection timing (the output timing of a horizontal synchronizing signal) to the write start timing of an image.

The image forming apparatus forms a pattern image for color deviation (positional deviation) detection for each development color on the conveyance belt 3 in order to improve the quality of an image formed on a sheet by correcting the above color deviation. The image forming apparatus further corrects the color deviation detected in the above manner in accordance with the color deviation values detected by the registration detection sensors 6L and 6R.

<Detection of Color Deviation>

Figure 4:
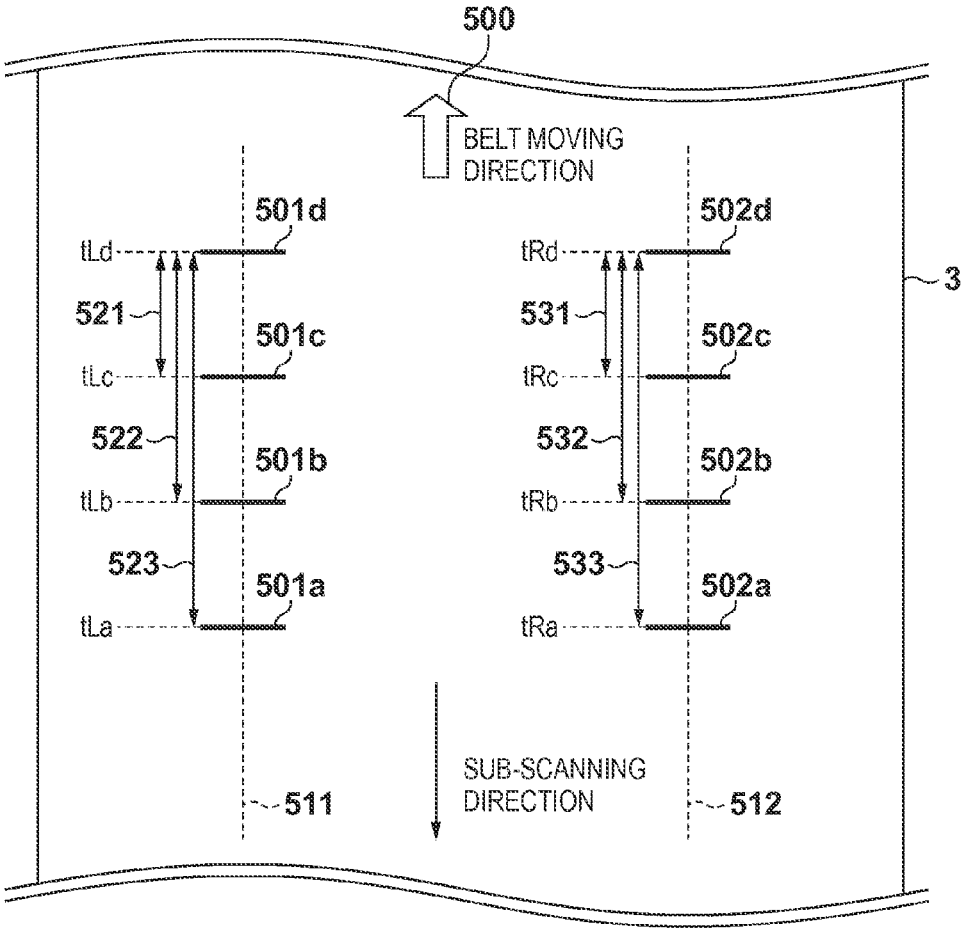
FIG. 4 is a view showing a color deviation detection pattern image used in the image forming apparatus according to the first embodiment.

A method of detecting the above color deviation by using the registration detection sensors 6L and 6R will be described next. FIG. 4 shows an example of a pattern image for color deviation detection (to be referred to as a "detection pattern" or "pattern" hereafter) formed on the conveyance belt 3. FIG. 4 shows linear patterns 501*a* to 501*d* and 502*a* to 502*d* each drawn as an example of a detection pattern in a direction perpendicular to a conveyance (moving) direction 500 of the conveyance belt 3. The respective patterns assigned with the suffixes a to d are the patterns respectively formed on the conveyance belt 3 by using Y, M, Y, and K toners. The registration detection sensors 6L and 6R respectively detect the patterns on lines 511 and 512. Reference symbols tLa to tLd and tRa to tRd respectively denote the detection timings of the patterns 501*a* to 501*d* and 502*a* to 502*d* by the registration detection sensors 6L and 6R.

In this case, reference numerals 521 to 523 and 531 to 533 denote the intervals between the K patterns 501*d* and 502*d* of the reference color K as references, and the patterns 501*a*, 501*b*, and 501*c* and 502*a*, 502*b*, and 502*c* of the remaining colors (C, M, and Y). The ideal values of the intervals 521 to 523 (531 to 533) are respectively represented by dCK, dMK, and dYK. The ideal values respectively correspond to the intervals between the patterns of the respective colors which are detected without any color deviation. Letting V [mm/sec] be the ideal moving speed of the peripheral surface of the conveyance belt 3, color deviation values ΔyL and ΔyR of C, M, and Y relative to a reference color K, which are detected by the registration detection sensors 6L and 6R are given by $$\Delta yLC=V^*(tLa-tLd)-dCK \quad (1)$$

$$\Delta yLM=V^*(tLb-tLd)-dMK \quad (2)$$

$$\Delta yLY=V^*(tLc-tLd)-dYK \quad (3)$$

$$\Delta yRC=V^*(tRa-tRd)-dCK \quad (4)$$

$$\Delta yRM=V^*(tRb-tRd)-dMK \quad (5)$$

$$\Delta yRY=V^*(tRc-tRd)-dYK \quad (6)$$

In this case, it can be determined, based on the signs of the values as calculation results obtained by equations (1) to (6), whether the formation positions of the patterns are offset forward or backward in the sub-scanning direction. In addition, the write start position in the sub-scanning direction from (ΔyL+ΔyR)/2 and the tilt of the scanning line from (ΔyR−ΔyL) are corrected based on these calculation results.

The image forming apparatus according to this embodiment forms detection patterns on the conveyance belt 3 and detects the patterns by using the pair of registration detection sensors 6R and 6L. The image forming apparatus further calculates the differences between the detection timing of the pattern of the reference color K and the detection timings of the patterns of the remaining colors as color deviation values. These color deviation values are indices for quantitatively evaluating color deviations as positional deviations when images of colors other than the reference color K are superimposed on an image of the reference color K. This embodiment uses, for example, the pattern shown in FIG. 4 as a color deviation detection pattern. The image forming apparatus further performs color deviation correction by processing (to be specifically described below) based on calculated color deviation values. Note that it is possible to execute color deviation correction at a timing independently of general image formation processing, for example, the power-on timing.

A moving speed V of the peripheral surface of the conveyance belt 3 is not always constant and can fluctuate due to the unevenness of rotation speed of the driving roller 4. The unevenness of speed of the driving roller 4 can occur at the same period as the rotation period of the driving roller 4 due to the eccentricity of the driving roller 4, the gears of a driving unit (not shown) which drives the driving roller 4, the driving motor, and the like. In addition, the unevenness (fluctuations) of speed of a long period equal to the rotation period of the conveyance belt 3 can occur in the moving speed V due to the unevenness of the thickness of the conveyance belt 3. Such moving speed fluctuations of the peripheral surface of the conveyance belt 3 cause detection errors proportional to the time differences between the detection timings of different color patterns in the detection results on the above detection patterns.

When, therefore, forming patterns of the respective colors used for color deviation detection on the conveyance belt 3, this embodiment adjusts the intervals between the patterns of the different colors to proper intervals, as will be described below. With this operation, the embodiment has a feature of reducing color deviation detection errors as compared with a case in which detection patterns of all the colors are simultaneously transferred to be formed at equal intervals on the conveyance belt 3.

<Arrangement of Control Block Associated with Color Deviation Correction>

Figure 5:
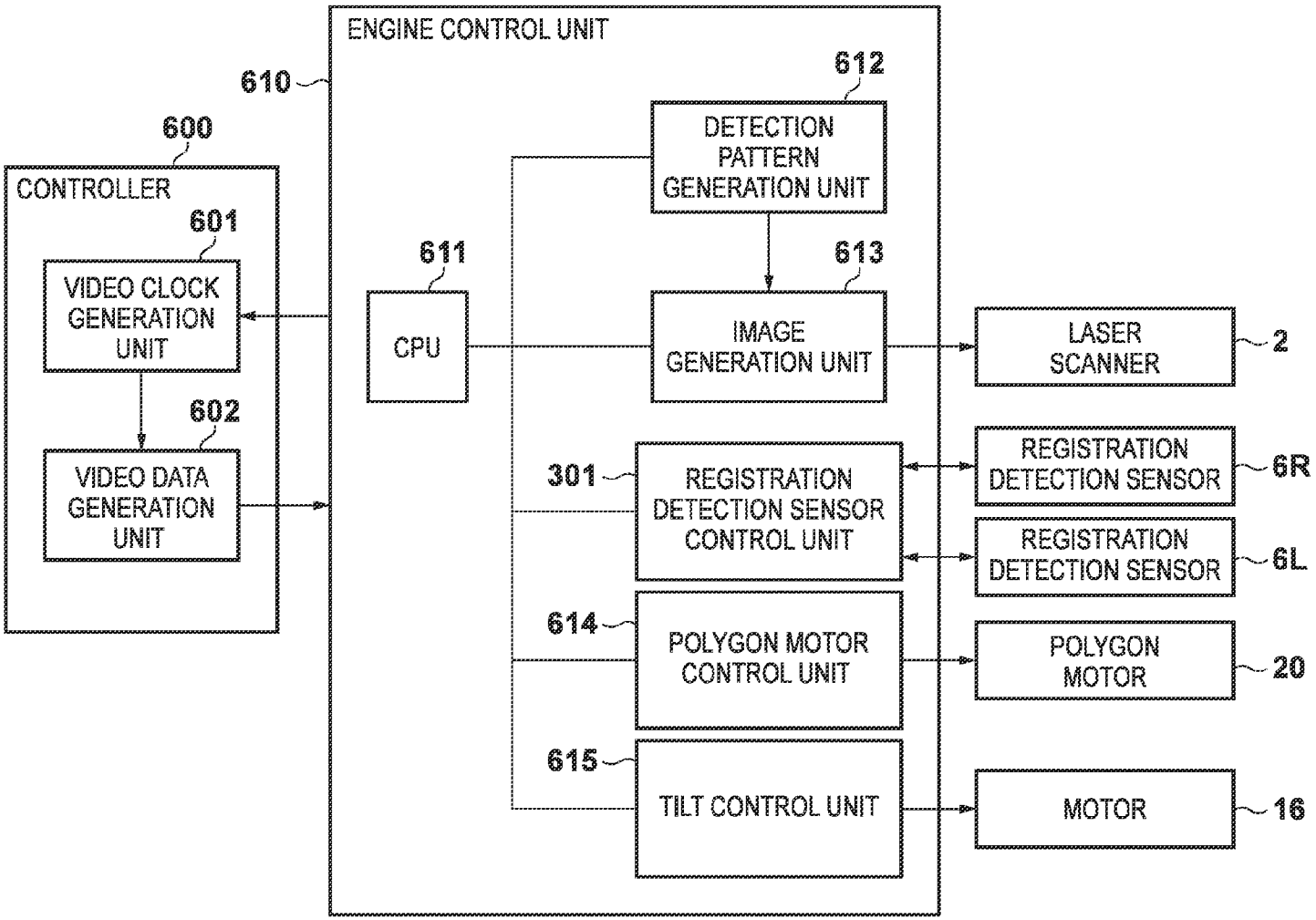
FIG. 5 is a block diagram showing a control arrangement associated with color deviation correction in the image forming apparatus according to the first embodiment.

The arrangement of a control block associated with color deviation correction in the image forming apparatus according to this embodiment will be described next with reference to FIG. 5. A CPU (main control unit) 611 controls the operation timing of each block in an engine control unit 610 via a bus, and also controls communication between the respective blocks and communication between the engine control unit 610 and a controller 600. When starting color deviation correction at the power-on timing or the like, the apparatus generates image signals representing detection patterns (to be described later) by using a detection pattern generation unit 612. An image generation unit 613 converts the detection patterns generated by the detection pattern generation unit 612 into image signals of the respective colors of C, M, Y, and K, and outputs them to the laser scanners 2*a*, 2*b*, 2*c*, and 2*d*, respectively. The laser scanners 2*a*, 2*b*, 2*c*, and 2*d* form detection patterns on the conveyance belt 3 by the above image formation processing.

The detection patterns formed on the conveyance belt 3 are detected by using the registration detection sensors 6R and 6L. The registration detection sensor control unit 301 calculates color deviation values from the detected values by controlling the registration detection sensors 6R and 6L, and calculates correction values necessary for color deviation correction from the color deviation values. The registration detection sensor control unit 301 outputs the calculated correction values to a polygon motor control unit 614, a tilt control unit 615, and the controller 600 which execute color deviation correction (to be described later).

<Tilt Correction in Sub-scanning Direction>

Figure 6A:
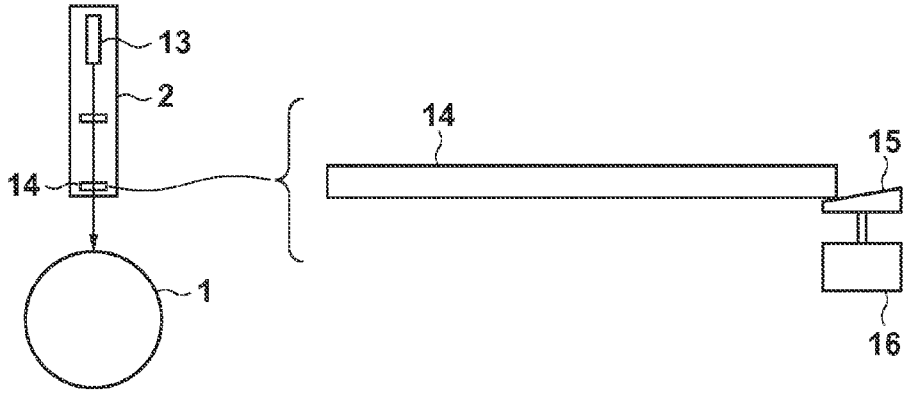
FIG. 6A is a view showing an arrangement for correcting the tilt of the sub-scanning direction in the image forming apparatus according to the first embodiment.

Tilt correction in the sub-scanning direction will be described next with reference to FIG. 6A. As shown in FIG. 6A, a tilt correction lens 14 has one end supported by a cam 15 attached to the shaft of a motor 16. When the cam 15 rotates as the motor 16 rotates, the position of one end of the tilt correction lens 14 changes, and the incident position of a laser beam deflected by a polygon mirror 13 on the photosensitive drum 1 changes. The tilt control unit 615 corrects the tilt in the sub-scanning direction by operating the motor 16 in accordance with the calculated color deviation value. At this time, the tilt correction lens 14 moves to the other end with reference to one end. With this operation, for example, while one end is fixed, only the other end moves in the main scanning direction on an image, and hence the write start position in the sub-scanning direction simultaneously changes. Therefore, the write start position in the sub-scanning direction is corrected in accordance with the operation amount of the tilt correction lens 14 based on tilt correction.

<Correction of Write Start Position in Sub-scanning Direction>

Correction of a write start position in the sub-scanning direction will be described next. The polygon motor control unit 614 corrects a write start position in the sub-scanning direction based on a correction value for the write start position in the sub-scanning direction, which is obtained from a calculated color deviation value, in the following manner. The following is an example in which correction is performed when a calculated color deviation value exhibits an error corresponding to two lines or ¼ line with respect to the write start position corresponding to the reference color. Note that when tilt correction in the sub-scanning direction has been performed in the above manner, the polygon motor control unit 614 corrects the write start position in the sub-scanning direction with a correction amount calculated in consideration of also the variation of the write start position depending on the tilt correction.

In general, in a system using a laser scanner, the controller 600 causes a video data generation unit 602 to transmit image data line by line to the engine control unit 610 in synchronism with the horizontal synchronizing signal generated by the engine control unit 610 and transmitted to the controller 600. The horizontal synchronizing signal is generated for each surface of the polygon mirror in synchronism with the rotation of the polygon mirror. That is, the horizontal synchronizing signal is generated for each line in an image formation region. The polygon motor control unit 614 achieves the correction of a write start position in the sub-scanning direction by adjusting the transmission timing of a horizontal synchronizing signal transmitted to the controller 600.

Figure 6B:
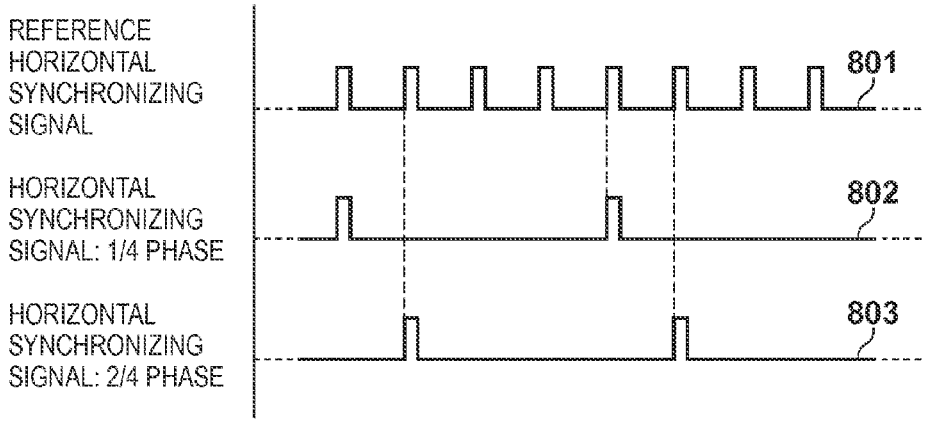
FIG. 6B is a timing chart of synchronizing signals associated with the correction of write start positions in the sub-scanning direction in the image forming apparatus according to the first embodiment.

The polygon motor control unit 614 advances or delays the timing of a horizontal synchronizing signal transmitted to the controller 600, for each line, with respect to the amount of line-based color deviation, thereby correcting the write start position in the sub-scanning direction. When, for example, correcting a write start position in the sub-scanning direction backward by two lines, the polygon motor control unit 614 increments the count of clocks of a horizontal synchronizing signal by +2 until the start of the transmission of a horizontal synchronizing signal with reference to the transmission timing of vertical synchronizing signal. The polygon motor control unit 614 corrects the write start position by adjusting the phase of a horizontal synchronizing signal within one period with respect to the amount of color deviation within one line. FIG. 6B shows a reference horizontal synchronizing signal 801 that can be generated by the internal timer of the engine unit, which has a frequency four times that of a horizontal synchronizing signal. Assume that the current horizontal synchronizing signal has a phase of ¼ shown in FIG. 6B, and the write start position is corrected backward by ¼ line in the sub-scanning direction. In this case, the polygon motor control unit 614 may change the horizontal synchronizing signal for each color from a phase of ¼ (signal 802) to a phase of ¾ (signal 803).

<Correction of Main Scanning Width (Overall Magnification)>

Figure 7A:
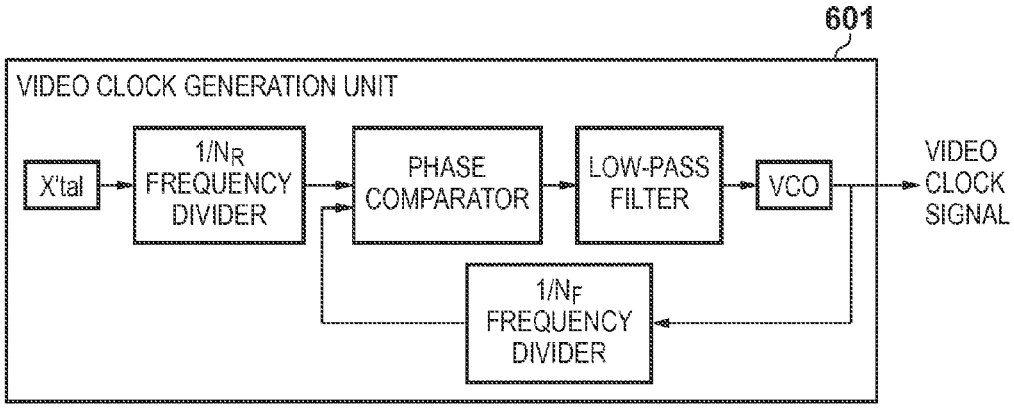
FIG. 7A is a block diagram showing the arrangement of a video clock generation unit 601 in the image forming apparatus according to the first embodiment.

Correction of a main scanning width (overall magnification) will be described next with reference to FIG. 7A. The video clock generation unit 601 includes a so-called PLL circuit. In the video clock generation unit 601 shown in FIG. 7A, a 1/NR frequency divider frequency-divides a clock signal output from a crystal oscillator (X'tal), and a phase comparator receives the resultant signal. In addition, a 1/NF frequency divider frequency-divides a video clock signal having a frequency fV output from the video clock generation unit 601, and the phase comparator receives the resultant signal. The phase comparator outputs, to a low-pass filter, pulses having different polarities and widths corresponding to the phase difference between the output from the 1/NR frequency divider and the output from the 1/NF frequency divider. The low-pass filter smoothes the signals input from the phase comparator, and outputs the resultant signals to a voltage-controlled oscillator (VCO). The VCO outputs a video clock signal having a frequency corresponding to an input voltage from the low-pass filter.

In this case, letting fX be the frequency of the X'tal, a video clock frequency fV is expressed by $$fV=(NR/NF)*fX$$

where NR and NF associated with the 1/NR frequency divider and 1/NF frequency divider are integers. It is obvious from the above equation that the video clock frequency fV can be adjusted by adjusting NR and NF. In this embodiment, therefore, the controller 600 corrects the main scanning width by changing the set values of NR and NF in accordance with the color deviation value calculated by the registration detection sensor control unit 301. Assume that the detection of the amount of color deviation indicates that the main scanning width is offset in a direction to decrease. In this case, in order to increase the main scanning width, the controller 600 decreases the video clock frequency fV (increases the period) by correcting the set values of NR and NF so as to decrease the ratio between NR and NF.

Note that when the video clock frequency changes owing to the above processing, the write start position in the main scanning direction also changes. For this reason, it is necessary to correct the write start position in the main scanning direction in accordance with the variation of such a video clock frequency, as will be described later. Proper correction amounts for the set values of NR and NF change depending on the circuit arrangement of the controller 600 even if detected color deviation values are the same. In addition, the jitter of the video clock frequency may increase depending on the relationship between the circuit arrangement of the controller 600 and the set values of NR and NF. In such a case, it is possible to reduce the jitter by adding or subtracting small values to or from the correction values for all the development colors to an extent that a change in the overall size of the image is visually unnoticeable.

<Correction of Write Start Position in Main Scanning Direction>

Correction of a write start position in the main scanning direction will be described next. The following is an example in which a calculated color deviation value has an error of two dots or ¼ dot with respect to the write start position for the reference color. Note that when the main scanning width has been corrected in the above manner, the write start position in the main scanning direction is corrected with a correction amount set in consideration of also the variation of the write start position depending on the correction of the main scanning width.

In general, in a system using a laser scanner, the engine control unit 610 transmits a horizontal synchronizing signal to the controller 600 for each line in an image formation region. The controller 600 causes the video clock generation unit 601 to generate a video clock signal in synchronism with the horizontal synchronizing signal transmitted from the engine control unit 610. The controller 600 transmits the image data (video data) of the image formation target which is generated by the video data generation unit 602 to the engine control unit 610 in synchronism with the video clock signal. With the above processing, the controller 600 performs correction to match write start positions for the respective lines.

Figure 7B:
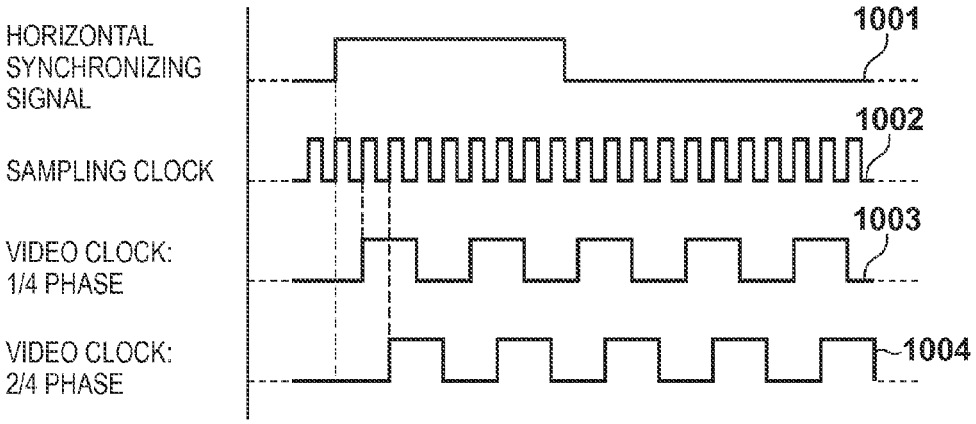
FIG. 7B is a timing chart of synchronizing signals associated with the correction of write start positions in the main scanning direction in the image forming apparatus according to the first embodiment.

When outputting image data to the engine control unit 610, the controller 600 corrects each write start position in the main scanning direction in the following manner. The controller 600 corrects the write start position by changing the count of video clocks, for a dot-based color deviation value, in the interval between the timing of a horizontal synchronizing signal and the transmission start timing of image data (corresponding to the position of the start of image formation). For example, it is possible to correct a write start position backward by two dots in the main scanning direction by incrementing the count by +2. The controller 600 also corrects a write start position for a color deviation value within one dot by starting to write image data at a timing corresponding to a proper correction amount in accordance with a sampling clock having a frequency higher than that of a video clock. FIG. 7B shows a case in which a sampling clock 1002 has a frequency four times that of video clock signals 1003 and 1004. If, for example, the phase of the current video clock is ¼ that shown in FIG. 7B, and the write start position is to be corrected backward by ¼ dot in the main scanning direction, the controller 600 changes the phase from a phase of ¼ (signal 1003) to a phase of ⅔ (signal 1004).

<Procedure for Color Deviation Correction>

A procedure for color deviation correction operation executed by the image forming apparatus according to this embodiment will be described with reference to the flowchart of FIG. 8. In step S101, the CPU 611 controls the detection pattern generation unit 612 to generate an image of detection patterns set at proper pattern intervals as described later. An EEPROM as a nonvolatile memory incorporated in the detection pattern generation unit 612 may store such detection patterns in advance. The image data of the detection patterns stored in the EEPROM may be data in the bitmap format or data in the vector format with a less data amount. The detection pattern generation unit 612 sends the image data read out from the EEPROM to the image generation unit 613, which expands the data into image signals of the respective colors and outputs them to the laser scanners 2*a*, 2*b*, 2*c*, and 2*d*, respectively. The CPU 611 then shifts the process to step S102.

In step S102, the CPU 611 controls each image forming unit to form a pattern of each color on the conveyance belt 3 as an endless belt by using the laser scanner 2 and the photosensitive drum 1 based on the image signal representing the detection pattern generated in step S101. Note that each detection pattern formed on the conveyance belt 3 will be described in detail laser. In step S103, the CPU 611 controls the registration detection sensor control unit 301 to detect each detection pattern formed on the conveyance belt 3 by using the registration detection sensors 6R and 6L in the above manner.

In step S104, the CPU 611 causes the registration detection sensor control unit 301 to calculate the above color deviation value for each color. Subsequently, in step S105, the CPU 611 obtains necessary correction values based on the calculation results on the color deviation values in step S104, and executes color deviation correction by using the correction values in the above manner.

<Setting of Detection Patterns>

Color deviation detection patterns used in this embodiment will be described next with reference to FIG. 4. As shown FIG. 4, the detection patterns corresponding to the respective colors are arranged in the following order in the moving direction of the conveyance belt 3, from the front to the rear: K (502*d*), Y (502*c*), M (502*b*), and C (502*a*). Note that reference numerals 521 to 523 and 531 to 533 denote the intervals (distances) between the patterns of the respective colors.

When the respective detection patterns are transferred from the photosensitive drums 1*a*, 1*b*, 1*c*, and 1*d* onto the conveyance belt 3, transfer positions on the conveyance belt 3 are generally arranged at equal intervals. In this case, when the detection patterns of the respective colors formed on the photosensitive drums 1*a*, 1*b*, 1*c*, and 1*d* are simultaneously transferred onto the conveyance belt, the respective transferred patterns are arranged at equal intervals in the moving direction 500 of the peripheral surface of the conveyance belt 3. In the case of such simultaneous transfer, no color deviation detection error occurs due to the speed fluctuations of the conveyance belt 3 at the time of transfer. On the other hand, since the pattern detection timings of the registration detection sensors 6L and 6R vary for each pattern, color deviation detection errors can occur due to the speed fluctuations at the time of detection. In order to suppress color deviation detection errors due to the speed fluctuations at the time of pattern detection, it is necessary to eliminate the distances between the detection patterns corresponding to the respective colors and form all the patterns at the same position in the moving direction 500 of the peripheral surface of the conveyance belt 3. In order to form such patterns on the conveyance belt 3, however, it is necessary to transfer the detection patterns of the respective colors at different timings. This leads to color deviation detection errors due to the speed fluctuations at the time of transfer.

This embodiment reduces color deviation detection errors due to the speed fluctuations of the conveyance belt 3 by transferring detection patterns of the respective colors from the respective photosensitive drums 1 onto the conveyance belt 3 at proper timings and forming the detection patterns on the conveyance belt 3 at proper intervals. More specifically, the intervals 521 to 523 and 531 to 533 between a pattern of the reference color K and patterns of the remaining colors are set to intervals that can reduce color deviation detection errors. Such detection patterns are determined at the design stage of the arrangement of the image forming apparatus in consideration of the order of colors to be transferred and the transfer positions of toner images of the respective colors with respect to the conveyance belt 3. The determined detection patterns may be stored in an EEPROM 81 in advance.

<Derivation of Proper Intervals between Detection Patterns>

A method of calculating pattern intervals for reducing color deviation detection errors due to the speed fluctuations of the conveyance belt 3 according to this embodiment will be described next. First of all, the following will describe equations for estimating color deviation detection errors caused by the speed fluctuations of the conveyance belt 3 at the time of transfer of detection patterns and at the time of detection of the patterns.

(Definitions of Necessary Parameters)

Figure 9:
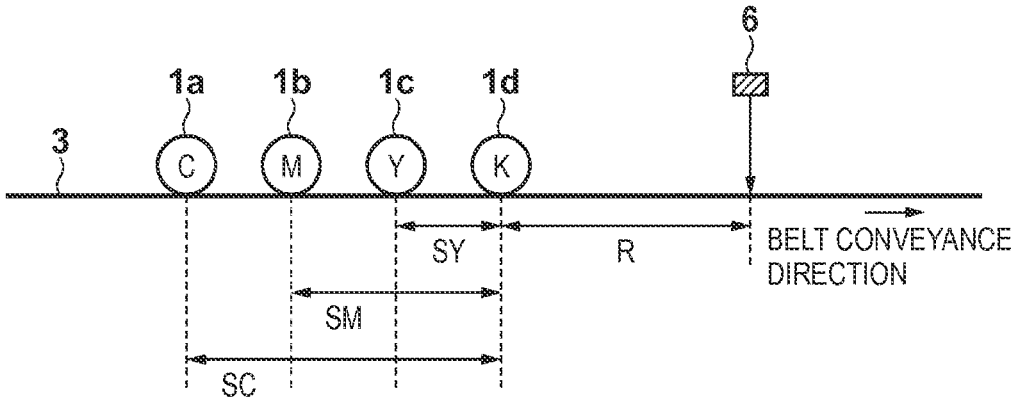
FIG. 9 is a view showing the arrangement of photosensitive drums 1*a*, 1*b*, 1*c*, and 1*d* and registration detection sensor 6 along the conveyance path of a conveyance belt 3 in the image forming apparatus according to the first embodiment.

As shown in FIG. 9, reference symbols SY, SM, and SC respectively denote the distances between the transfer position of the reference color K and the transfer positions of Y, M, and C on the conveyance path of the conveyance belt 3. In general, in order to reduce color deviation detection errors due to the moving speed fluctuations of the peripheral surface of the conveyance belt 3, which are caused by a factor of the driving system such as the eccentricity of the driving roller 4, the distance between adjacent transfer positions is matched with a peripheral length T of the driving roller 4. In this embodiment as well, SY=T, SM=2T, and SC=3T. Note that T is, for example, 75 [mm]. Reference symbol R in FIG. 9 denotes the distance between the transfer position of the detection pattern of the reference color K and the detection position where the registration detection sensor 6 reads and detects the detection pattern on the conveyance path of the conveyance belt 3. Note that R is, for example, 210 [mm].

(Definitions of Transfer and Detection Timings)

FIG. 10 shows the detection timings of detection patterns of the respective colors by each registration detection sensor in a case in which the transfer timings of the respective patterns on the conveyance belt 3 are represented by tK, tY, tM, and tC, respectively. It is possible to obtain these detection timings based on the distance between the transfer positions for the respective colors and the registration detection sensor 6 and the moving speed V of the peripheral surface of the conveyance belt 3.

(Definitions of Offset Values)

Figure 11:
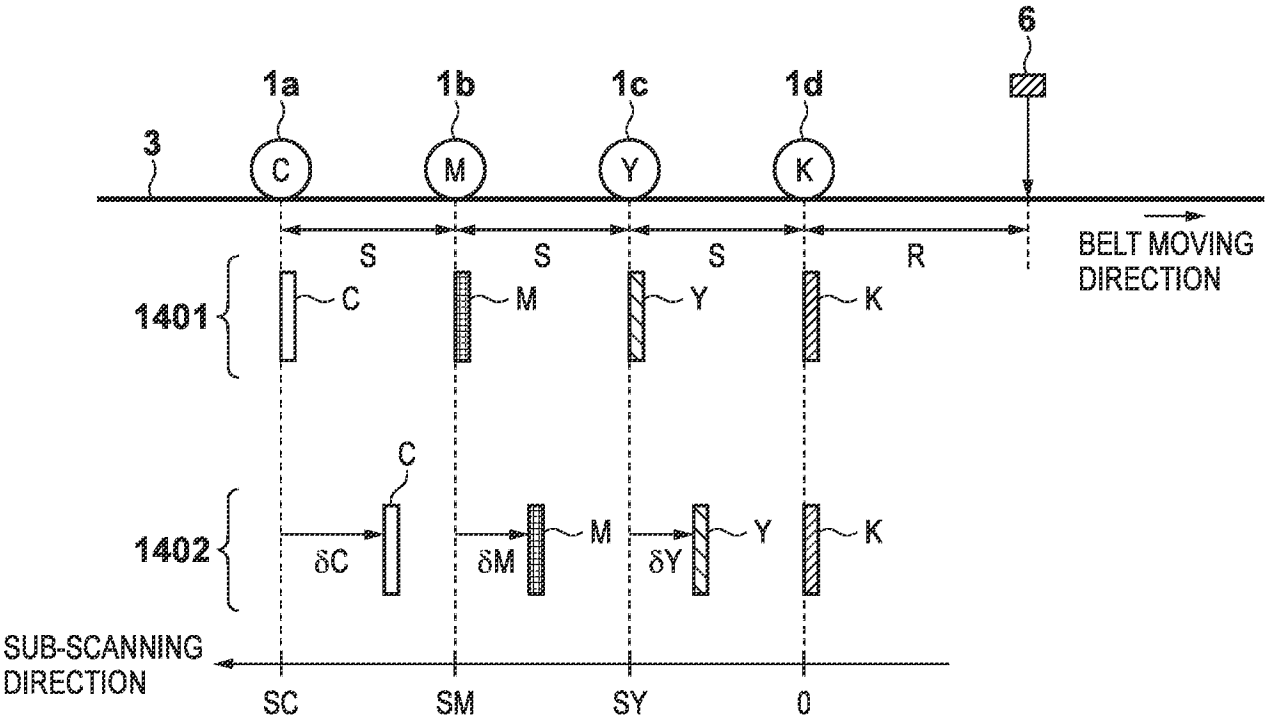
FIG. 11 is a view showing the arrangement of color deviation detection pattern images formed on the conveyance belt 3 in the image forming apparatus according to the first embodiment.

FIG. 11 shows transfer patterns 1401 obtained by simultaneously transferring patterns of the respective colors and transfer patterns 1402 obtained by transferring patterns of Y, M, and C other than the reference color K onto the conveyance belt 3 upon offsetting them forward by predetermined distances in the moving direction of the conveyance belt 3. Note that the intervals between the adjacent transfer positions on the conveyance path of the conveyance belt 3 are set to equal intervals S, and the distance from the transfer position from the photosensitive drum 1*d* to the detection position of the registration detection sensor 6 is represented by R. In this case, the transfer patterns 1402 are obtained by offsetting the patterns of Y, M, and C of the transfer patterns 1401, which are simultaneously transferred, by distances δY, δM, and δC, respectively, in a direction opposite to the sub-scanning direction (that is, the moving direction of the conveyance belt 3). As shown in FIG. 11, in this embodiment, the image forming apparatus sets the intervals between detection patterns of the respective colors to distances that allow to reduce positional deviation detection errors due to the speed fluctuations of the conveyance belt 3. In addition, the apparatus transfers the patterns of the respective colors from the photosensitive drums 1*a*, 1*b*, 1*c*, and 1*d* onto the conveyance belt 3 at timings that match the intervals between the patterns of the respective colors transferred onto the conveyance belt 3 with the set distances.

(Transfer Timings of Respective Colors)

Figure 12:
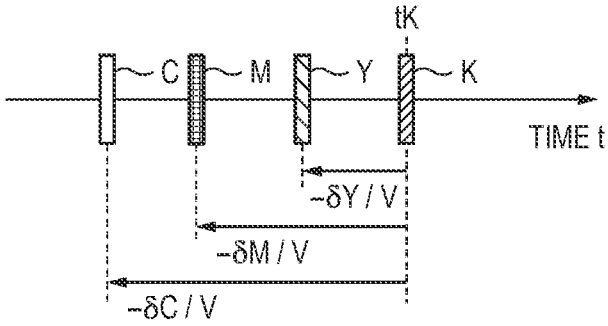
FIG. 12 is a view showing the transfer timings of color deviation detection pattern images in the image forming apparatus according to the first embodiment.

FIG. 12 shows the respective transfer timings when the image forming apparatus transfers the respective patterns onto the conveyance belt 3 so as to match the intervals between the patterns of the respective colors with the distances shown in FIG. 11. Here, assume that the transfer timing when detection patterns of all the colors are simultaneously transferred is set to a transfer timing tK of the reference color K. In this case, in order to offset the transfer positions of the detection patterns of Y, M, and C in the case of simultaneous transfer by δY, δM, and δC shown in FIG. 11, it is necessary to set the transfer timings tY, tM, and tC of the respective colors to timings before the timing tK in the following manner.

$$tY=tK-\delta Y/V \tag{7}$$

$$tM=tK-\delta M/V \tag{8}$$

$$tC=tK-\delta C/V \tag{9}$$

As indicated by these equations, it is possible to implement the transfer patterns 1402 shown in FIG. 11 by advancing the transfer timings of patterns of the respective colors by δY/V, δM/V, and δC/V, respectively, relative to the transfer timing tK of the reference color K.

(Profile of Speed Fluctuations of Conveyance Belt 3)

Figure 13:
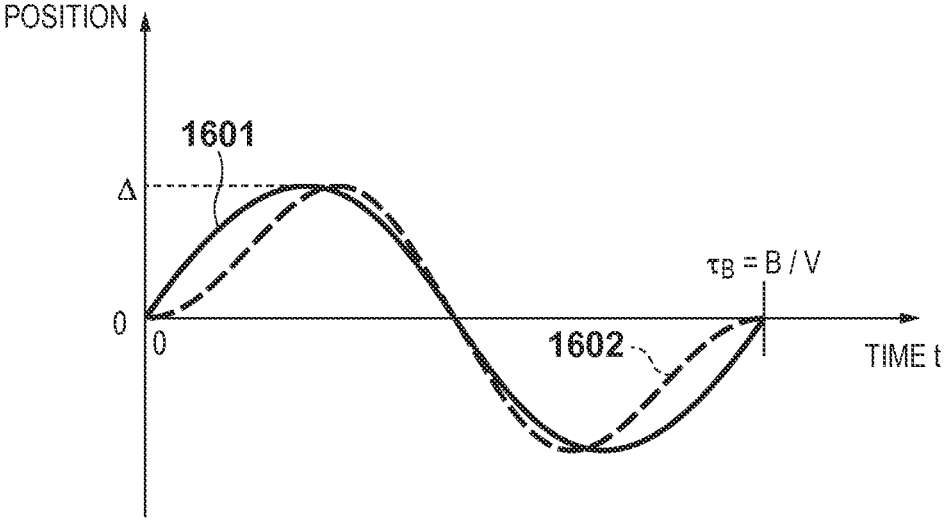
FIG. 13 is a graph showing profiles corresponding to positional deviations caused by the moving speed fluctuations of the peripheral surface of the conveyance belt 3 in the image forming apparatus according to the first embodiment.

FIG. 13 shows changes (positional deviation) in the position of a pattern on the conveyance belt 3 from the position where the pattern should be formed, which are caused by moving speed fluctuations occurring at a specific period equal to the rotation period of the conveyance belt 3. Here, the moving speed fluctuations of the peripheral surface of the conveyance belt 3 can be approximated by a sin wave like a waveform 1601. Assume that such speed fluctuations of the conveyance belt 3 occur at the transfer position of a detection pattern and the detection position of the pattern and at the same timing with the same magnitude. Note that a peripheral length B of the conveyance belt 3 can be, for example, 850 [mm], and its rotation period can be expressed by τB=B/V [sec].

(Positional Deviation at Transfer and Detection Timings)

Figure 14:
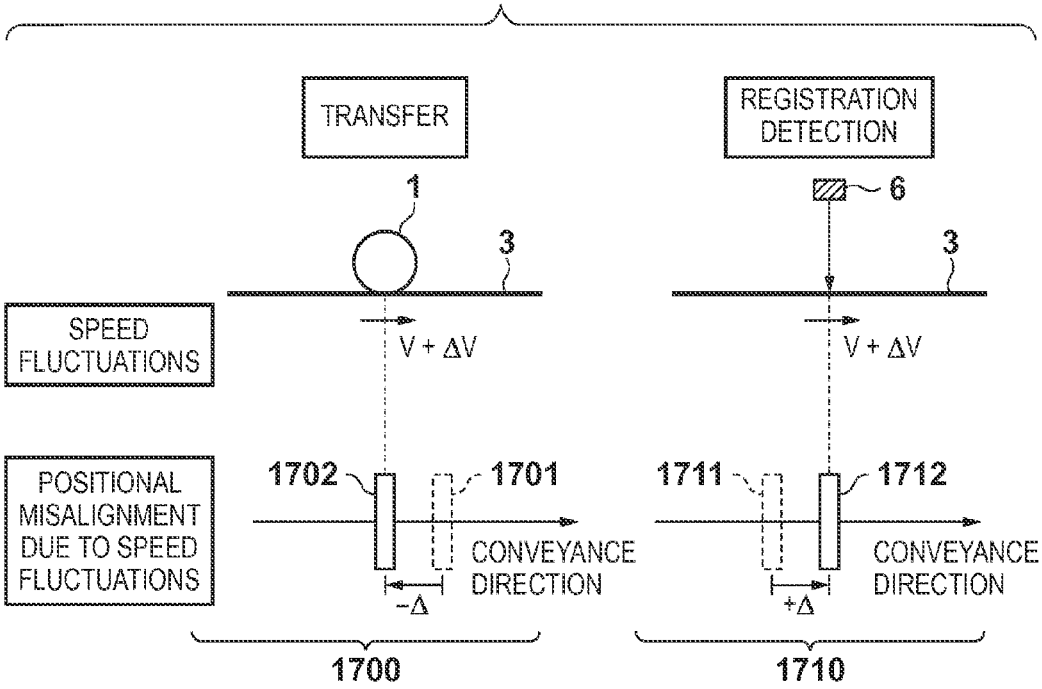
FIG. 14 is a view showing positional deviations due to the speed fluctuations of the conveyance belt 3 at the times of transfer and detection of a color deviation detection pattern image in the image forming apparatus according to the first embodiment.

FIG. 14 shows changes in position due to the speed fluctuations of the conveyance belt 3 at the times of transfer and detection of a detection pattern. Referring to FIG. 14, as indicated by "1700", when a fluctuation ΔV occurs in the moving speed of the peripheral surface of the conveyance belt 3 at the time of transfer of a detection pattern, the pattern is transferred at a position 1702 on the conveyance belt 3 which is offset from an ideal position 1701 without fluctuation. Note that Δ represents the absolute value of a change in position due to a speed fluctuation ΔV of the conveyance belt 3. In this case, when a position speed fluctuation (+ΔV) occurs in the moving direction of the conveyance belt 3, the transfer position of the detection pattern changes (−Δ) backward from the ideal position 1701 in the moving direction.

When the fluctuation ΔV occurs in the moving speed of the peripheral surface of the conveyance belt 3 at the time of detection of a detection pattern as indicated by "1710", the pattern is detected at a position 1712 offset from an ideal position 1711 without speed fluctuation by a variation Δ on the conveyance belt. When a positive speed fluctuation (+ΔV) occurs in the moving direction of the conveyance belt 3, the detection position of the detection pattern changes (+Δ) forward from the ideal position 1711 in the moving direction. As is obvious from the above description, the direction (the sign) of a change in position due to the moving speed fluctuations of the peripheral surface of the conveyance belt 3 at the time of pattern transfer is opposite to that at the time of detection. A variation ΔT(t) of the transfer position which occurs at the time of pattern transfer and a variation ΔS(t) of the detection position which occurs at the time of pattern detection, at time t, are expressed by $$\Delta T(t)=-\Delta \sin(2\pi t/\tau B) \tag{10}$$

$$\Delta S(t)=\Delta \sin(2\pi t/\tau B) \tag{11}$$

(Calculation of Detection Error for Each Color)

This embodiment reduces color deviation detection errors with reference to a total variation obtained by totalizing the variation of the transfer position of a pattern on the conveyance belt 3 and the variation of the detection position of the pattern on the conveyance belt 3, which occur when the moving speed of the peripheral surface of the conveyance belt 3 fluctuates at the specific period. Note that the specific period in this embodiment is the same period as the rotation period of the conveyance belt 3. First of all, color deviation detection errors ΔYK, ΔMK, and ΔCK between the reference color K and Y, M, and C other than the reference color can be expressed by the following equations with reference to a transfer time tK of the reference color K:

$$\Delta YK(tK,\delta Y)=\{\Delta T(tK-\delta Y/V)+\Delta S(tK-\delta Y/V+(R+SY)/V)\}-\{\Delta T(tK)+\Delta S(tK+R/V)\} \tag{12}$$

$$\Delta MK(tK,\delta M)=\{\Delta T(tK-\delta M/V)+\Delta S(tK-\delta M/V+(R+SM)/V)\}-\{\Delta T(tK)+\Delta S(tK+R/V)\} \tag{13}$$

$$\Delta CK(tK,\delta C)=\{\Delta T(tK-\delta C/V)+\Delta S(tK-\delta C/V+(R+SC)/V)\}-\{\Delta T(tK)+\Delta S(tK+R/V)\} \tag{14}$$

In these equations, the third and fourth terms of the right-hand sides represent the total variations of variations of the transfer position and detection position of the pattern of the reference color K from the ideal positions on the conveyance belt 3. On the other hand, the first and second terms of the right-hand sides represent the total variations of variations of the transfer positions and detection positions of the patterns of Y, M, and C other than the reference color from the ideal positions on the conveyance belt 3. In equations (12) to (14), the differences between these variations are calculated as ΔYK, ΔMK, and ΔCK, which correspond to color deviation detection errors. As indicated by equations (12) to (14), it is possible to express the color deviation detection errors ΔYK, ΔMK, and ΔCK as functions between the transfer time tK of the reference color K and the offset values δY, δM, and δC of the respective patterns.

As described above, color deviation detection errors change with tK. This indicates that a color deviation detection error changes depending on the phase relationship of the speed fluctuations of the conveyance belt 3 which is determined by the transfer and detection timings of each pattern. It is therefore possible to reduce color deviation detection errors by properly adjusting the phase relationship of the speed fluctuations by changing the transfer and detection timings of each pattern. More specifically, this embodiment determines the intervals (first intervals) between detection patterns of the respective colors which should be formed on the conveyance belt 3 such that the phase relationship of the speed fluctuations of the conveyance belt 3 at the times of transfer and detection coincides with a phase relationship that reduces color deviation detection errors.

(Equations for Maximum Detection Errors for Respective Colors)

The optimal intervals (first intervals) between detection patterns of the respective colors formed on the conveyance belt 3 will be described next. In order to obtain the optimal pattern intervals, it is necessary to estimate errors based on the phase relationship when the maximum color deviation detection error appears. That is, it is necessary to make examination with reference to a value corresponding to the maximum color deviation detection error when the transfer timing tK for the reference color K is changed within the range of $0 \leq tK < \tau B$ throughout a period τB of the conveyance belt 3. Letting ΔmaxYK, ΔmaxMK, and ΔmaxCK be the maximum detection errors for the respective colors, they can be expressed by $$\Delta maxYK = \max(|\Delta YK(tK)|, 0 \leq tK < \tau B) \quad (15)$$

$$\Delta maxMK = \max(|\Delta MK(tK)|, 0 \leq tK < \tau B) \quad (16)$$

$$\Delta maxCK = \max(|\Delta CK(tK)|, 0 \leq tK < \tau B) \quad (17)$$

An examination will be made on pattern intervals optimal for reducing color deviation detection errors due to the moving speed fluctuations of the peripheral surface of the conveyance belt 3 at the times of transfer and detection of the detection patterns based on these equations.

(Optimization of Pattern Intervals)

Figure 15:
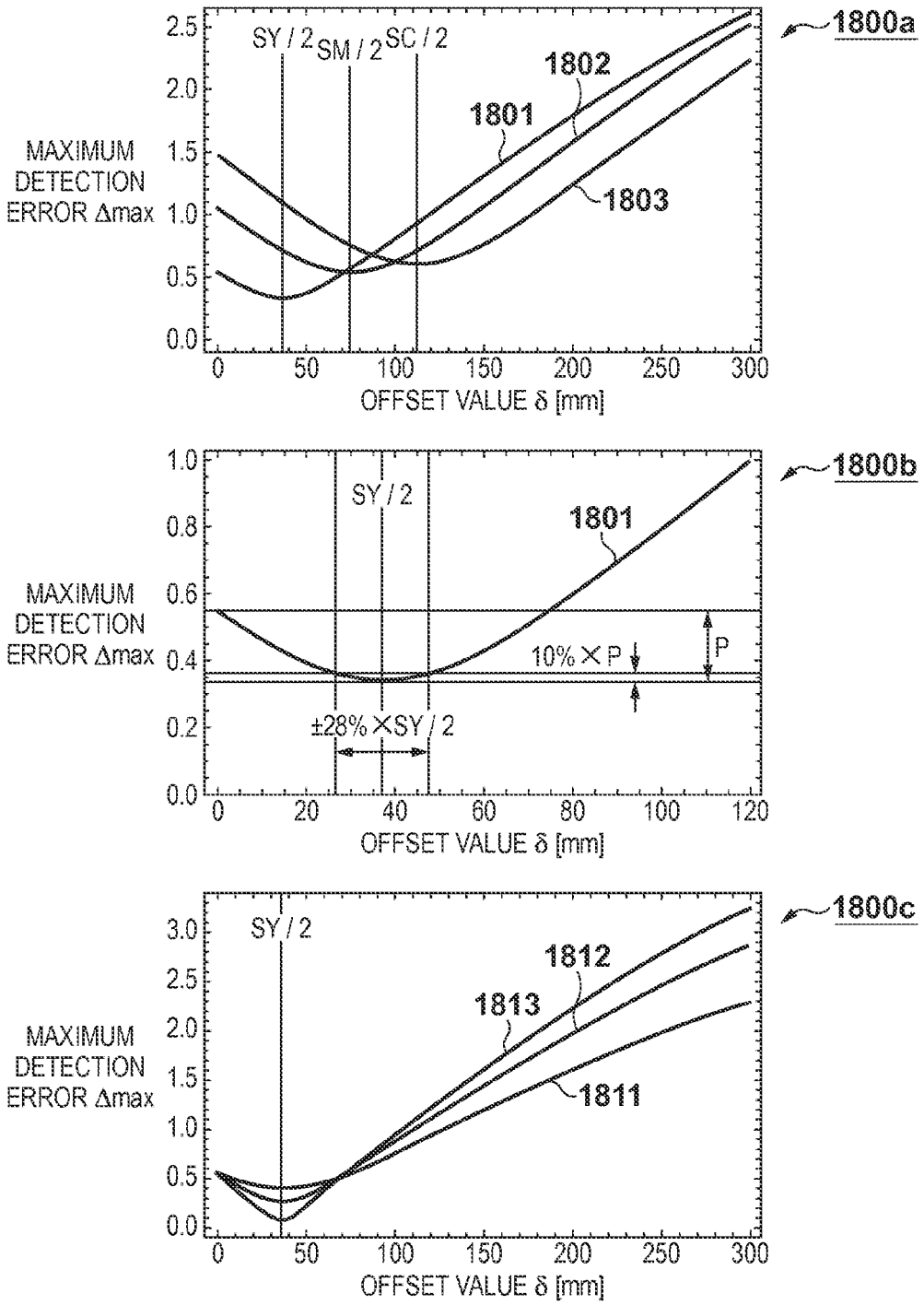
FIG. 15 is a graph showing the calculation results obtained by calculating color deviation maximum detection errors with respect to offset values in the image forming apparatus according to the first embodiment.

Optimal pattern intervals based on equations (15) to (17) will be described next. Reference numeral 1800*a* in FIG. 15 denotes the calculation results on the maximum detection errors ΔmaxYK, ΔmaxMK, and ΔmaxCK when the above offset values (δY, δM, and δC) are changed. Note that reference numerals 1801 to 1803 respectively denote ΔmaxYK, ΔmaxMK, and ΔmaxCK, and detection errors which appear when the offset values (δY, δM, and δC) are 0 [mm] correspond to detection errors which appear when detection patterns of the respective colors are simultaneously transferred onto the conveyance belt 3. As shown in FIG. 15, when detection patterns of the respective colors are simultaneously transferred, it is not possible to minimize detection errors. This indicates that there are offset values that can reduce detection errors more than in this case. It is also obvious that the offset values that minimize the maximum detection errors ΔmaxYK, ΔmaxMK, and ΔmaxCK are δY=SY/2, δM=SM/2, and δC=SC/2 for the respective colors of Y, M, and C. That is, the calculations using equations (15) to (17) reveal that the optimal offset values that can reduce color deviation detection errors are the values obtained by multiplying the intervals SY, SM, and SC between the transfer position of the reference color K and the transfer positions of Y, M, and C by ½.

Figure 16:
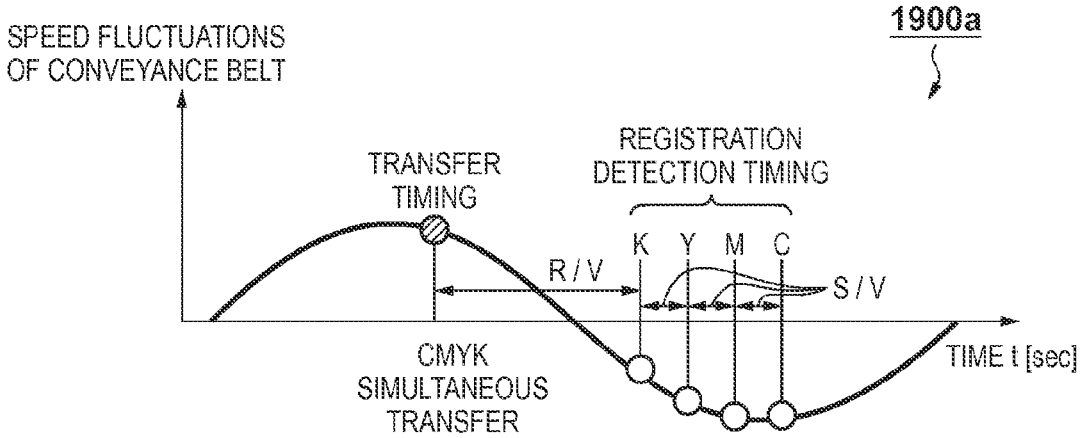
FIG. 16 is a graph showing the transfer timings and detection timings of color deviation detection pattern images in the image forming apparatus according to the first embodiment.
Figure 16:
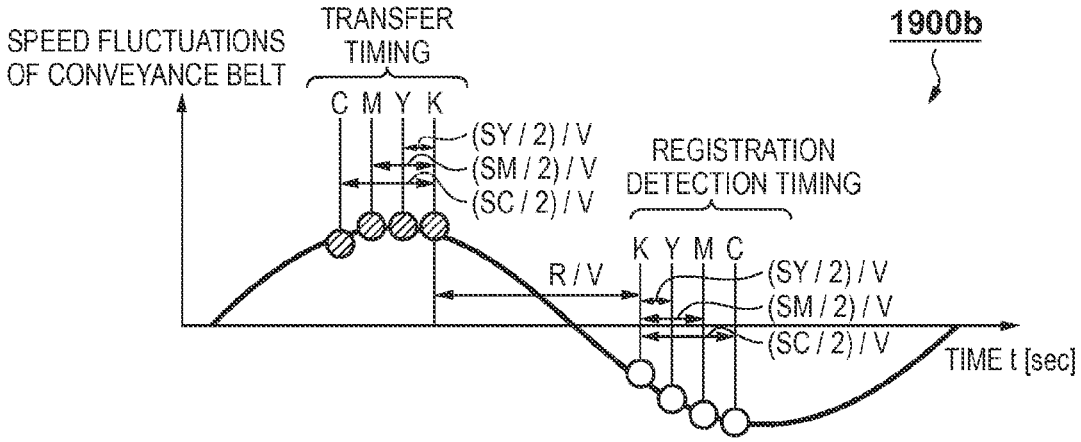

The transfer timings at which detection patterns of the respective colors are transferred onto the conveyance belt 3 in accordance with the above offset values will be described with reference to FIG. 16. Referring to FIG. 16, the ordinate represents the speed fluctuation components of the conveyance belt 3; and the abscissa, the time. FIG. 16 shows an example of the transfer timings and detection timings of color deviation detection patterns. Reference numeral 1900*a* denotes a case in which the patterns of the respective colors are simultaneously transferred; and 1900*b*, a case in which the patterns of the respective colors are transferred based on the above offset values. In the case 1900*a*, assume that the intervals between the adjacent patterns on the conveyance belt 3, when the detection patterns of the respective colors are simultaneously transferred, are equal intervals S, and the moving speed of the peripheral surface of the conveyance belt 3 is a speed V. In this embodiment, as indicated by the case 1900*b*, the transfer timings of Y, M, and C are advanced from the transfer timing of the reference color K by times δY/V, δM/V, and δC/V corresponding to offsets δY=SY/2, δM=SM/2, and δC=SC/2. This operation offsets the detection timings of patterns of the respective colors of Y, M, and C with respect to the detection timing of the reference color K by the times δY/V, δM/V, and δC/V (the time differences between the detection timings decrease as compared with the case of simultaneous transfer).

(Position Dependence of Registration Detection Sensors 6L and 6R)

Referring to FIG. 15, reference numeral 1800*c* denotes the calculation results on the maximum detection error ΔmaxYK with changes in the distance R, on the conveyance belt 3, between the transfer position of a pattern of reference color K and the detection position where the pattern is detected by the registration detection sensor 6. Reference numerals 1811 to 1813 respectively denote the calculation results on ΔmaxYK when R=170 [mm], R=250 [mm], and R=350 [mm], respectively. As shown in FIG. 15, although the minimum value of the maximum detection error changes depending on R, the offset value δY by which the minimum value is obtained is equal to SY/2 regardless of the value of R. It is therefore obvious that optimal pattern intervals do not depend on the distance R.

<Color Deviation Correction Using Detection Patterns at Set Intervals>

Figure 8:
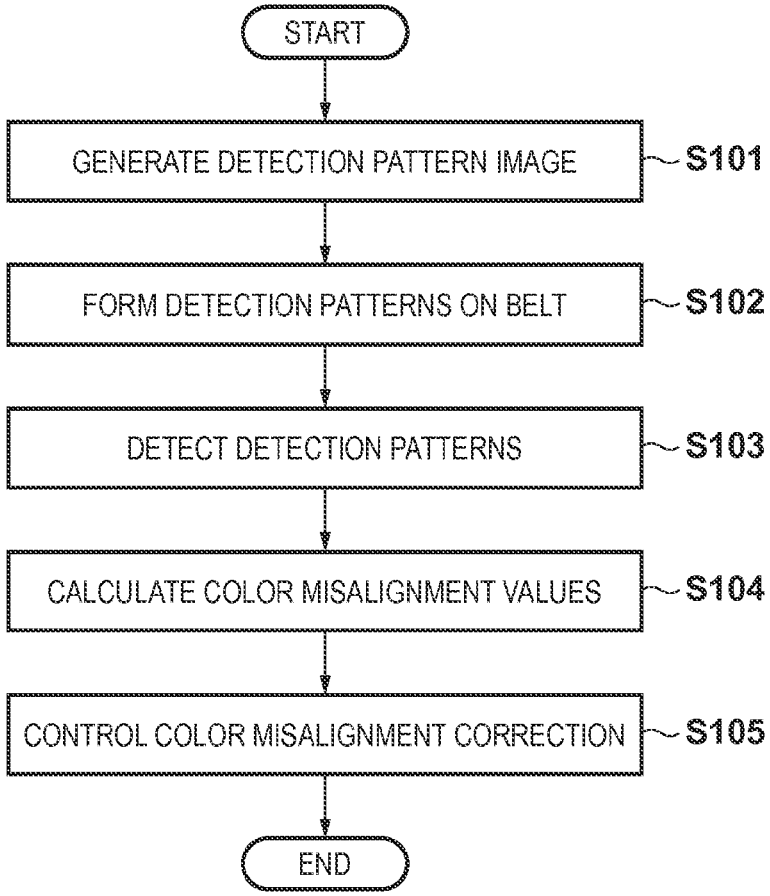
FIG. 8 is a flowchart showing a procedure for color deviation correction operation executed in the image forming apparatus according to the first embodiment.

In this embodiment, in step S102 in FIG. 8, the CPU 611 forms detection patterns of the respective colors on the conveyance belt 3 upon setting the pattern intervals 521 and 531, 522 and 532, and 523 and 533 shown in FIG. 4 to SY/2, SM/2, and SC/2, respectively. Thereafter, in step S104, the CPU 611 calculates color deviation values for the respective colors based on the detection results on the patterns on the conveyance belt 3 in step S103. In step S105, the CPU 611 executes color deviation correction based on the calculation results.

As described above, in this embodiment, the image forming apparatus forms color deviation detection patterns on the conveyance belt 3 at intervals that can reduce color deviation detection errors, which are determined in accordance with the phase relationship of the speed fluctuations of the conveyance belt 3 at the transfer and detection timings of the color deviation detection patterns. The apparatus further executes color deviation correction based on the detection results on the patterns formed on the conveyance belt 3. Generating such detection patterns and storing them in a storage device in advance can accurately reduce color deviation detection errors by simple processing. This can improve the accuracy of color deviation correction and the image quality of an image formed on a recording material. In addition, it is possible to further reduce color deviation detection errors by setting the above offset values to the values obtained by multiplying the intervals SY, SM, and SC between the transfer position of the reference color K and the transfer positions of Y, M, and C by ½.

<Effective Range and Modifications of Embodiment>

The effective range and several modifications of this embodiment will be described below. Reference numeral 1800*b* in FIG. 15 denotes an enlarged view of the curve 1801 included in the case 1800*a* in FIG. 15 in association with δY=0 to 120 [mm]. Reference numeral P in the case 1800*c* in FIG. 15 denotes an improvement amount of ΔmaxYK from offset value δY=0 (simultaneous transfer) at the optimal offset value SY/2 that minimizes the maximum detection error ΔmaxYK. Assume that the range of 10% of an improvement amount P is defined as the allowable range of ΔmaxYK. This is because it is thought that if an improvement amount of the maximum detection error ΔmaxYK falls within the range of 10% of the improvement amount P, it is possible to sufficiently reduce positional deviation detection errors as compared with the case of simultaneous transfer. In this embodiment, as indicated by "1800*c*", the offset value δY within the allowable range is ±28% with respect to the optimal offset value δY=SY/2. That is, the offset value δY that falls within the range of (SY/2)×72%≤δY (SY/2)×128% can fall within the allowable range. It has been revealed that the range of offset values corresponding to the range of 10% of the maximum improvement amount described above changes depending on the peripheral length B of the conveyance belt 3, the distance R, and the distances SY, SM, and SC between the transfer positions of patterns of the respective colors.

Figure 17:
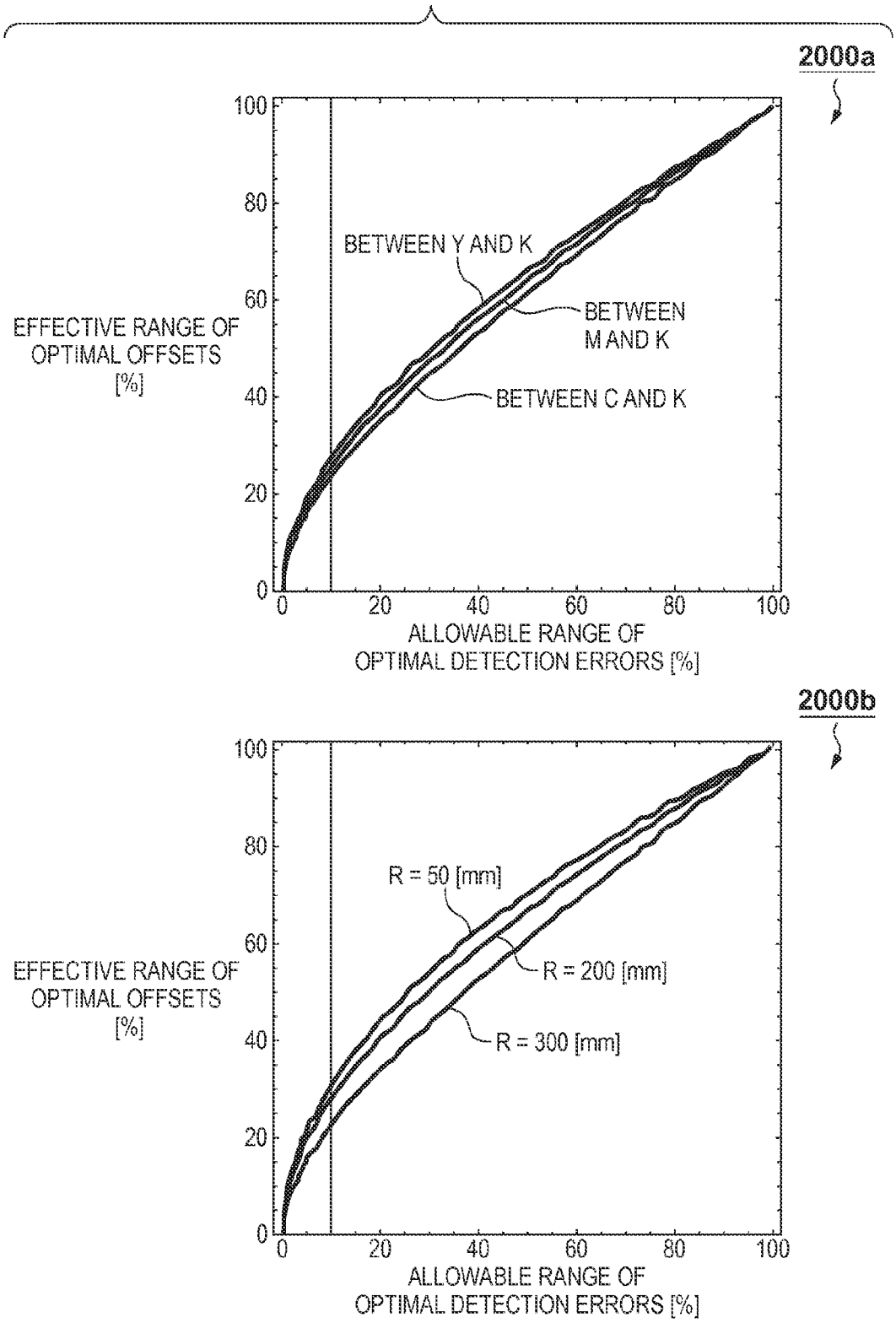
FIG. 17 is a graph showing the calculation results on the effective ranges of optimal offset values in the image forming apparatus according to the first embodiment.

FIG. 17 shows the relationship between the allowable range of color deviation detection errors and the offset values δY, δM, and δC. First of all, the curves indicated by "2000*a*" in FIG. 17 respectively indicate offset values for Y and K, M and K, and C and K, thereby showing comparison between characteristics appearing when the intervals between the transfer positions differ from each other. Considering, for example, the allowable range of maximum detection errors corresponding to the above range of 10% of the maximum improvement amount, it is obvious from FIG. 17 that when the intervals between the transfer positions differ from each other, the effective range of offset values also changes. In addition, the respective curves indicated by "2000*b*" in FIG. 17 indicate the maximum color deviation detection errors between Y and K when distance R=50, 200, and 300 [mm]. It is obvious from FIG. 17 that the effective range of offset values also changes depending on the distance R. It is also obvious that when the distances between the transfer positions of patterns of the respective colors and the distance R change within a practical range, the effective range of offset values within the 10% of the allowable range of maximum detection errors becomes maximum in a case where the distance R is set to a small value. That is, when R=50 [mm], the effective range of offset values becomes maximum, with the maximum value being 32%. It has been revealed that even if the distance R is set to be smaller than 50 [mm], the maximum value does not exceed 32%. It can therefore be concluded that the upper limit of the effective range of offset values is 32%, and that any offset values equal to or lower than 32% can be regarded as almost proper pattern intervals.

(Profiles of Speed Fluctuations of Conveyance Belt 3)

This embodiment assumes that a cause for the unevenness of moving speed of the peripheral surface of the conveyance belt 3 is the unevenness of speed occurring at a specific period which is a relatively long period and equal to the rotation period of the conveyance belt 3 due to the unevenness of thickness of the conveyance belt 3 and the like. In addition, the embodiment obtains proper inter-pattern distances by approximation with a profile using a sin wave indicated by the waveform 1601 in FIG. 13. It is, however, possible to approximate this unevenness of speed by using a profile obtained by distorting the sin wave as indicated by, for example, a waveform 1602. A modification of this embodiment which uses such a profile can also reduce color deviation detection errors.

(Correction in Main Scanning Direction)

This embodiment has mainly exemplified the operation of correcting color deviation in the sub-scanning direction based on the detection results obtained by the registration detection sensors 6R and 6L. However, since the detection patterns described in the embodiment can improve the color deviation detection accuracy, it is possible to improve the accuracy of color deviation correction in the main scanning direction.

Figure 22:
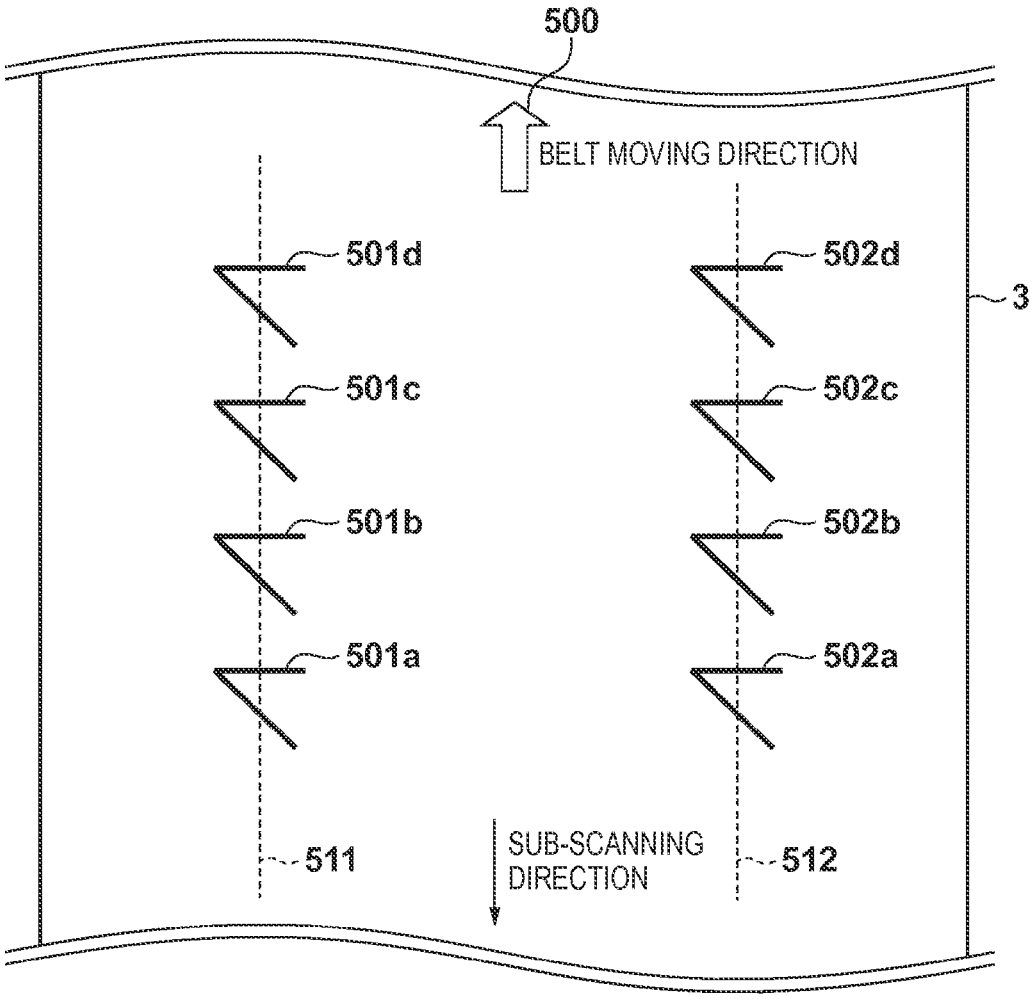
FIG. 22 is a view showing a modification of a color deviation detection pattern image used in the image forming apparatus according to the first embodiment.

Note that the detection patterns to be used are not limited to those shown in FIG. 4, and it is possible to use different patterns. For example, using patterns like those shown in FIG. 22 can reduce color deviation detection errors in the same manner as described above. That is, the present invention can use arbitrary shapes as the shapes of detection patterns, and can reduce color deviation detection errors by using detection patterns of any shapes by properly setting the intervals between the patterns in the above manner. In addition, this embodiment sets, as a reference color when detecting color deviation, K corresponding to the photosensitive drum 1*d* on the most downstream side along the moving direction of the conveyance belt 3. However, the present invention is not limited to this case. Even if a color other than K on the most downstream side is set as a reference color, it is possible to obtain pattern intervals for the reduction of color deviation detection errors in the same manner as described above.

Second Embodiment

The first embodiment designs detection patterns to reduce color deviation detection errors caused by the long-period speed fluctuations associated with the conveyance belt 3. Note that speed fluctuations occurring in the moving speed of the peripheral surface of the conveyance belt 3 do not always include only long-period speed fluctuation components associated with the conveyance belt 3. In some cases, the moving speed fluctuations of the peripheral surface of the conveyance belt 3 include not only fluctuations of a specific period equal to the rotation period of the conveyance belt 3 but also fluctuations of a period different from the specific period. For example, speed fluctuations of a relatively short period equal to the rotation period of the driving roller 4 of the conveyance belt 3 may have occurred in the moving speed of the peripheral surface of the conveyance belt 3. This embodiment reduces color deviation detection errors caused by not only long-period speed fluctuation components associated with a conveyance belt 3 but also speed fluctuation components of a relatively short period such as speed fluctuation components associated with a driving roller 4. Note that a description of portions common to the first embodiment will be omitted or simplified.

Figure 18:
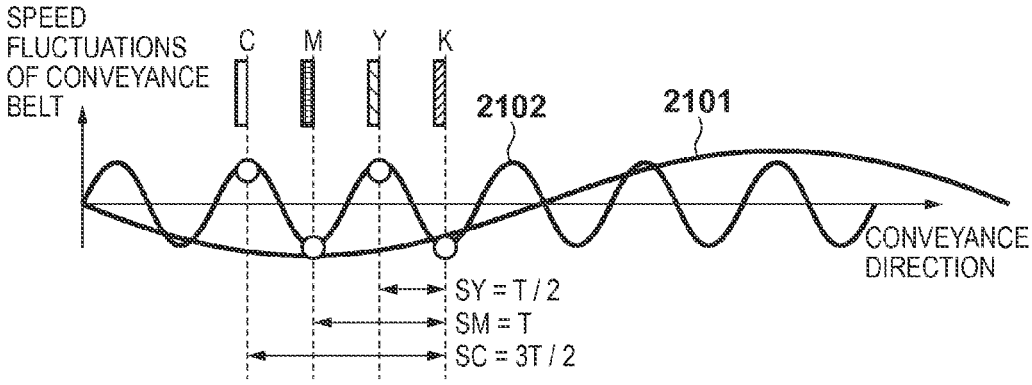
FIG. 18 is a graph showing the relationship between the fluctuation components of the moving speeds of the peripheral surface of the conveyance belt 3 and the peripheral surface of a driving roller 4 and the intervals between color deviation detection pattern images in an image forming apparatus according to the second embodiment.

The influence of color deviation detection errors caused by short-period speed fluctuation components like those described above may significantly increase depending on the relationship with long-period speed fluctuation components associated with the conveyance belt 3. Referring to FIG. 18, reference numeral 2101 denotes a long-period speed fluctuation component associated with the conveyance belt 3; and 2102, a speed fluctuation component associated with the driving roller 4. Note that the peripheral length of the driving roller 4 is represented by T. In the first embodiment, the peripheral length T is equal to the interval between the transfer positions of the respective colors. As shown in FIG. 18, it is obvious that there are combinations of colors which make detection errors associated with the driving roller 4 have opposite phases between patterns of different colors. According to the first embodiment, this is because the intervals between patterns of the respective colors each become an integer multiple of half of the peripheral length T of the driving roller 4. That is, detection errors associated with the driving roller 4 may considerably deteriorate depending on the combinations of YK, CK, MY, and CM.

In order to reduce such deterioration, an image forming apparatus according to the second embodiment forms a plurality of detection patterns for each color on the conveyance belt 3, and averages the detection results obtained by using the patterns. The following is an example in which detection errors due to speed fluctuation components occurring at a period equal to the rotation period of the driving roller 4 as short-period speed fluctuation components associated with the unevenness of moving speed of the peripheral surface of the conveyance belt 3 are to be reduced.

Figure 19:
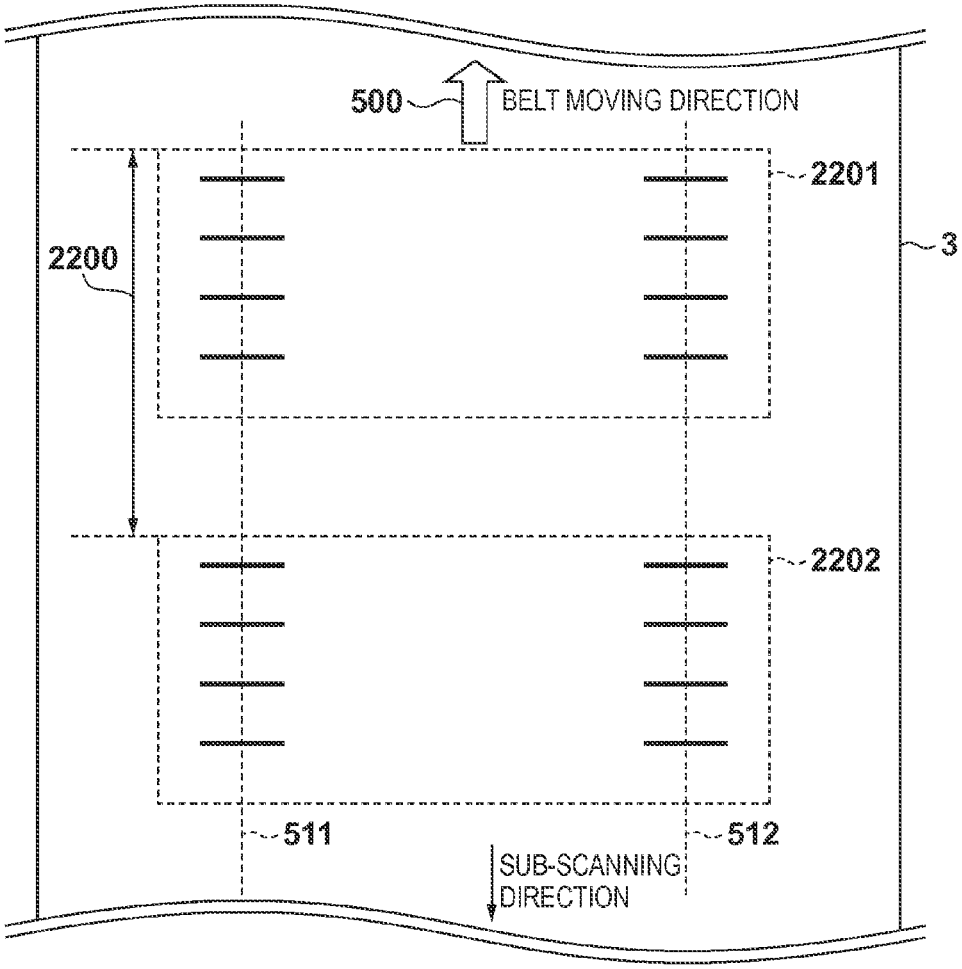
FIG. 19 is a view showing color deviation detection pattern images used in the image forming apparatus according to the second embodiment.

FIG. 19 shows detection patterns formed on the conveyance belt 3 in this embodiment. FIG. 19 shows a case in which two pattern image groups 2201 and 2202 are formed on the conveyance belt 3 at intervals 2200 as a set of detection patterns (pattern image group) of the respective colors used in the first embodiment. Here, the interval 2200 represents the interval between the first pattern images respectively included in the different pattern groups, and is set in accordance with a distance corresponding to the period of speed fluctuation components corresponding to detection errors which should be reduced, that is, a peripheral length T of the driving roller 4. As in this embodiment, when detection errors associated with the driving roller 4 are to be reduced, the interval 2200 is set to an interval (second interval) equal to the distance that the peripheral surface of the conveyance belt 3 moves during one period of speed fluctuation components of the moving speed of the peripheral surface of the conveyance belt 3 due to the driving roller 4. More specifically, it is possible to set the value obtained by multiplying ½ of the peripheral length T by an odd number as the interval 2200. In this case, it is assumed that the interval is set to 7T/2=262.5 [mm].

The image forming apparatus then calculates color deviation values by using the two sets 2201 and 2202 of detection patterns as in the first embodiment, and obtains average color deviation values by averaging the calculated color deviation values of the respective sets in step S104 in FIG. 8. In step S105, the apparatus obtains necessary correction values based on the obtained average color deviation values, and executes color deviation correction by using the correction values.

As described above, this embodiment can cope with, as the moving speed fluctuations of the peripheral surface of the conveyance belt 3, not only long-period speed fluctuation components associated with the conveyance belt 3 but also speed fluctuation components of a relatively short period such as speed fluctuation components associated with the driving roller 4. That is, it is possible to reduce positional deviation detection errors caused by such short-period speed fluctuation components and improve the accuracy of color deviation correction.

Note that this embodiment need not execute averaging processing for long-period components such as speed fluctuation components associated with the conveyance belt 3, and is required to execute averaging processing only for short-period fluctuation components. Even if, therefore, a plurality of detection patterns for each color are formed on the conveyance belt 3, it is possible to decrease the number of detection patterns to be formed as compared with the conventional technique disclosed in Japanese Patent Laid-Open No. 2001-356542 and the like. This also makes it possible to decrease the consumed amount of toner necessary to form detection patterns as compared with the conventional technique.

In addition, this embodiment has exemplified the case in which detection errors associated with short-period speed fluctuation components are reduced by using two sets of detection patterns. However, the number of sets of detection patterns to be formed on the conveyance belt 3 is not limited to two. It is possible to form three or more sets of detection patterns on the conveyance belt 3. Assume that the image forming apparatus uses n sets of detection patterns. In this case, letting L be a distance corresponding to the period of speed fluctuation components corresponding to detection errors to be reduced, it is possible to set the intervals between the respective sets to L/n. This makes it possible to reduce detection errors due to target speed fluctuation components, and hence to further reduce color deviation detection errors.

Third Embodiment

In the first embodiment, "1800*b*" in FIG. 15 indicates that an offset value that minimizes a positional deviation detection error does not depend on the distance R between the transfer position of a detection pattern of the reference color K and the detection position where the registration detection sensor 6 detects the transferred detection pattern. On the other hand, the embodiment has described that the minimum value changes depending on the distance R. The feature of the third embodiment lies in that a distance R is set to a distance that allows to further reduce positional deviation detection errors. Note that this embodiment uses the same detection patterns as those used in the first embodiment as color deviation detection patterns. A description of portions common to the first and second embodiments will be omitted or simplified.

Figure 20:
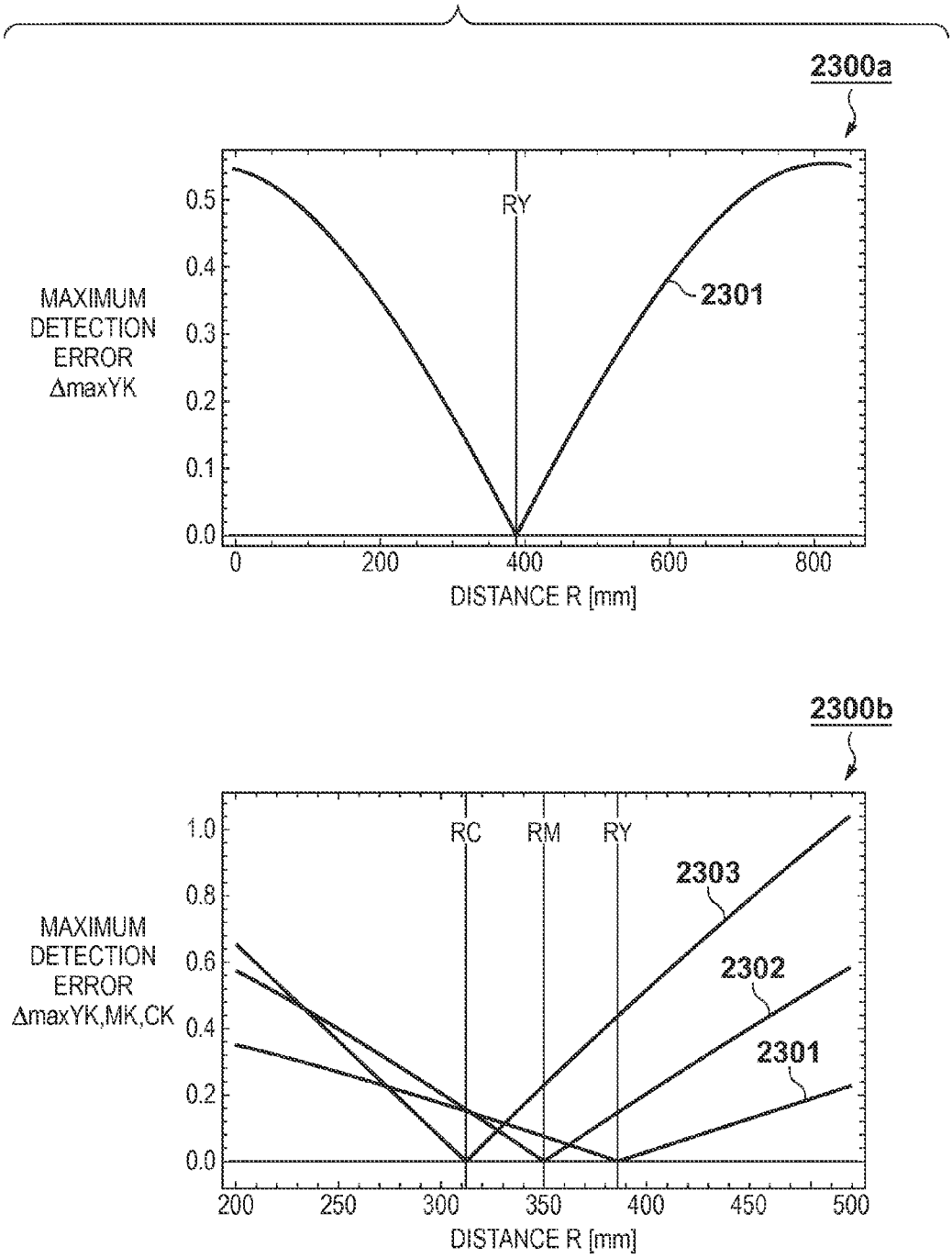
FIG. 20 is a graph showing the calculation results on maximum detection errors with respect to distances R in an image forming apparatus according to the third embodiment.

Referring to FIG. 20, "2300*a*" indicates calculated values 2301 of maximum detection errors ΔmaxYK between Y and K as the distance R changes. As indicated by "1800*b*", the maximum detection error changes depending on the distance R. A theoretical calculation has revealed that there is the distance R that reduces the maximum detection error to 0. When peripheral length B of belt=850 [mm] and distance SY between transfer positions of Y and K=75 [mm] as in this embodiment, an optimal value RY of the distance R that reduces the maximum detection error to 0 is RY=387.5 [mm].

Figure 21:
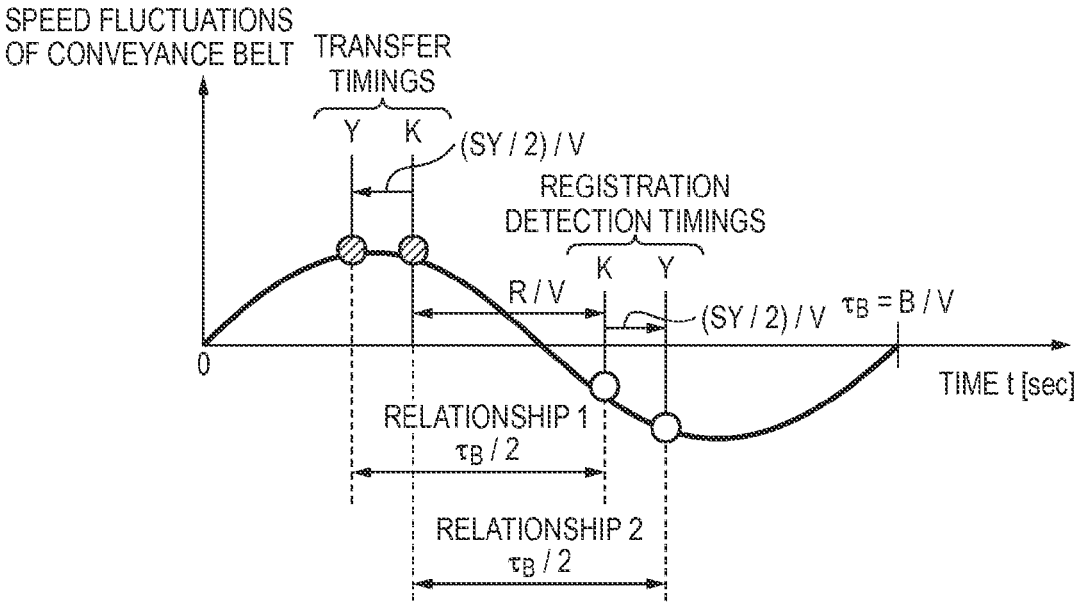
FIG. 21 is a graph showing the relationship between the fluctuation components of the moving speed of the peripheral surface of a conveyance belt 3 and the transfer and detection timings of a color deviation detection pattern image in the image forming apparatus according to the third embodiment.

The reason why the maximum detection error is reduced depending on the distance R will be described next with reference to FIG. 21. FIG. 21 shows how speed fluctuations (unevenness of speed) occur in the moving speed of the peripheral surface of a conveyance belt 3 at the same period as the rotation period of the conveyance belt 3, and the transfer and detection timings of detection patterns of Y and K. In this case, the pattern interval between Y and K is set to the interval SY/2 described in the first embodiment. For this reason, the difference between the transfer and detection timings of Y and K is (SY/2)/V. Referring to FIG. 21, relationship 1 indicates a combination of the transfer timing of a pattern of Y and the detection timing of a pattern of K. Relationship 2 indicates a combination of the detection timing of the pattern of Y and the transfer timing of the pattern of K. The intervals of the timings included in relationships 1 and 2 are the same, and can be expressed as (R+SY/2)/V by using the distance R. If the distance R is set to $$R=B/2-SY/2 \tag{18}$$

then, the timing intervals in relationships 1 and 2 are (B/2)/V=τB/2 [sec], which is ½ the rotation period of the conveyance belt 3. That is, the speed fluctuations of the conveyance belt 3 have an opposite phase relationship at the two timings included in relationships 1 and 2.

The above relationship will be described in detail below. By substituting δY=SY/2 into equation (12), the color deviation detection error between Y and K can be expressed as $$\Delta YK(tK)=\{\Delta T(tK-(SY/2)/V)+\Delta S(tK+(R+SY/2)/V)\}-\{\Delta T(tK)+\Delta S(tK+R/V)\} \tag{19}$$

In this equation, the first and fourth terms of the right-hand side correspond to relationship 1, and the second and third terms correspond to relationship 2. As described with reference to FIG. 14 in the first embodiment, since positional deviations occurring at the time of pattern transfer and the time of pattern detection due to the speed fluctuations of the conveyance belt 3 have opposite signs, ΔT(t)=−ΔS(t) according to equations (10) and (11). As described above, the terms corresponding to relationships 1 and 2 included in equation (19) can be transformed as follows:

relationship 1:

$$\Delta T(tK-SY/V)+\Delta T((tK-SY/V)+\tau B/2)=0 \tag{20}$$

relationship 2:

$$-\Delta T(tK+\tau B/2)-\Delta T(tK)=0 \tag{21}$$

As indicated by equations (20) and (21), since the speed fluctuations of the conveyance belt 3 have opposite phases at the two timings respectively included in relationships 1 and 2, detection errors cancel each other in relationships 1 and 2 into 0. Setting the distance R to the relationship represented by equation (18) will reduce detection errors to 0. The optimal value RY of the distance R that reduces detection errors to 0 can be easily calculated according to RY=850/2-75/2=387.5 [mm] based on equation (18).

It should be noted that the optimal value RY exists only when the interval between patterns of the respective colors is set to ½ the interval between the transfer positions. That is, it is possible to set the distance R to the optimal value RY only by applying the pattern interval obtained in the first embodiment. It should also be noted that the above optimization of the distance R reduces only color deviation detection errors between Y and K but does not reduce color deviation detection errors between other colors (CK and MK).

A method of designing the distance R in consideration of not only color deviation detection errors between Y and K but also those between other colors (CK and MK) will be described next. Referring to FIG. 20, "2300*b*" indicates not only calculated values 2301 of the maximum detection error ΔmaxYK between Y and K but also calculated values 2302 and 2303 of the maximum detection error ΔmaxMK and the maximum detection error ΔmaxCK between M and K, and C and K other between Y and K. As is obvious from "2300*b*", the distance R corresponding to the minimum value of the maximum detection error varies between Y and K, M and K, and C and K. The optimal value that minimizes the maximum detection error is obtained as RY 387.5 [mm] between Y and K, RM=350 [mm] between M and K, and RC=312.5 [mm] between R and C. The optimal values RM and RC can be obtained in the same manner as for the above optimal value RY by replacing SY of equation (18) with SM and SC.

As described above, since there is no distance R that reduces maximum detection errors to 0 between all the pairs of colors, that is, between Y and K, M and K, and C and K, it is necessary to determine the distance R based on one of the combinations of the colors. That is, it is necessary to determine the distance R based on the difference between the total variation of the transfer and detection positions of the reference color K and the total variation of those of one of the colors other than the reference color due to the speed fluctuations of the peripheral surface of the conveyance belt 3. More specifically, one of the maximum detection errors between Y and K, M and K, and C and K is selected, and a corresponding one of the optimal values RY, RM, and RC of the distance R is used.

If one of the detection errors between Y and K, M and K, and C and K is determined in advance as the detection error to be reduced, it is possible to determine an optimal value (RY, RM, or RC) corresponding to the detection error determined in advance as the distance R. Alternatively, it is possible to determine, as the distance R, one of the total values of maximum detection errors between Y and K, M and K, and C and K which is the minimum value. For example, referring to "2300*b*" in FIG. 20, this distance corresponds to RC. Note that the distance R that minimizes the total value of maximum detection errors corresponds to the optimal value RC of the maximum detection error between C and K, between which the distance between the transfer positions is the largest, independently of the transfer positions of the respective colors and the peripheral length of the conveyance belt 3. Various calculation results have confirmed this.

Alternatively, it is possible to determine, as the distance R, one of RY, RM, and RC which corresponds to the minimum value of the average values of the maximum detection errors between Y and K, M and K, and C and K. In this case, RM which is an optimal value corresponding to the maximum detection error between M and K is determined as the distance R in this embodiment.

This embodiment adds the following improvement to the image forming apparatuses according to the first and second embodiments. That is, registration detection sensors 6L and 6R are arranged such that the distance R between the registration detection sensors 6L and 6R and the transfer position by a photosensitive drum 1*d* on the most downstream side in the moving direction of the conveyance belt 3 becomes equal to the value determined in the above manner. Properly setting the distance R in this manner can further reduce color deviation detection errors as compared with the first and second embodiments. This makes it possible to execute color deviation correction more accurately and improve the quality of image formation.

Other Embodiments

The first to third embodiments have exemplified the image forming apparatuses each using, as an endless belt, the conveyance belt 3 which electrostatically adsorbs a sheet and conveys it to each image forming unit. However, the present invention is not limited to them. For example, the present invention can be applied to an image forming apparatus of an intermediate transfer system which uses an intermediate transfer belt as an endless belt. In this case, the respective toner images formed on the surfaces of the photosensitive drums 1*a*, 1*b*, 1*c*, and 1*d* are superimposed and transferred onto the surface of the intermediate transfer belt. This forms a color toner image on the surface of the intermediate transfer belt. Thereafter, the secondary transfer unit transfers the toner image on the intermediate transfer belt onto the surface of a sheet conveyed from a paper cassette. The image forming apparatus conveys the sheet whose surface has the color toner image to the fixing device. The fixing device then fixes the toner image on the sheet with heat and pressure. Thereafter, the sheet is discharged out of the image forming apparatus.

The image forming apparatus using such an intermediate transfer belt forms a color deviation detection pattern image on the surface of the intermediate transfer belt corresponding to an endless belt. The pair of registration detection sensors 6R and 6L detect the detection pattern image formed on the intermediate transfer belt. It is possible to implement formation of pattern images on the intermediate transfer belt and color deviation correction based on the detection results on the images in the same manner as in the first to third embodiments.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-278393, filed Dec. 14, 2010, which is hereby incorporated by reference herein in its entirety.

What is claimed is:

1. An image forming apparatus including an endless belt for formation of an image, a plurality of imaging forming units that are provided at positions different from each other along a moving direction of a peripheral surface of the endless belt and form images of different colors on the endless belt, and a sensor provided at a position on a downstream side relative to the plurality of image forming units along the moving direction of the peripheral surface of the endless belt, the apparatus comprising:

a pattern forming unit that forms a plurality of pattern images of different colors on the endless belt by using the plurality of image forming units, the plurality of pattern images of the different colors being used to calculate an amount of color deviation when a plurality of images of different colors are superimposed and formed on the endless belt;

a detection unit that detects, using the sensor, the plurality of pattern images formed on the endless belt by said pattern forming unit;

a calculation unit that calculates the amount of color deviation from detection results on the plurality of pattern images which are obtained by said detection unit; and a correction unit that corrects color deviation in accordance with the amount of color deviation calculated by said calculation unit, wherein said pattern forming unit forms the plurality of pattern images on the endless belt by using the plurality of image forming units at first intervals which reduce, to a predetermined allowable range, a total variation of a variation of a formation position where the pattern image is formed by the image forming unit on the endless belt with respect to an ideal position and a variation of a detection position where the sensor detects the pattern image with respect to an ideal position, the variations occurring when a moving speed of the peripheral surface of the endless belt fluctuates at a specific period, and wherein each of the first intervals is shorter than a distance between an image forming unit corresponding to a reference color and an image forming unit corresponding to each color other than the reference color.

2. The apparatus according to claim 1, wherein the first interval is an interval which reduces, to the predetermined allowable range, a difference between the total variation associated with the reference color and the total variation associated with each color other than the reference color, the total variations occurring when the moving speed of the peripheral surface of the endless belt fluctuates at the specific period.

3. The apparatus according to claim 1, wherein the first interval is an interval which minimizes, within the predetermined allowable range, a difference between the total variation associated with the reference color and the total variation associated with each color other than the reference color, the total variations occurring when the moving speed of the peripheral surface of the endless belt fluctuates at the specific period.

4. The apparatus according to claim 1, wherein the first interval between the pattern image formed by the image forming unit corresponding to the reference color, of the plurality of image forming units, which is located on a most downstream side along the moving direction of the peripheral surface of the endless belt, and the pattern image formed by the image forming unit corresponding to each color other than the reference color is ½ a distance between the image forming unit corresponding to the reference color and the image forming unit corresponding to each color other than the reference color, when the specific period associated with a moving speed fluctuation of the peripheral surface of the endless belt is equal to a rotation period of the endless belt.

5. The apparatus according to claim 1, wherein said pattern forming unit forms a plurality of pattern image groups at positions different from each other on the endless belt along the moving direction of the peripheral surface of the endless belt as pattern image groups by using the plurality of pattern images formed at the first intervals by using the plurality of image forming units, when a fluctuation of a period different from the specific period occurs in the moving speed of the peripheral surface of the endless belt.

6. The apparatus according to claim 5, wherein said pattern forming unit forms the plurality of pattern image groups on the endless belt such that an interval between first pattern images included in different pattern image groups in the moving direction of the peripheral surface of the endless belt becomes a second interval equal to a distance that the peripheral surface of the endless belt moves during one period of fluctuations occurring at a period different from the specific period.

7. The apparatus according to claim 5, wherein the period different from the specific period is a period equal to a rotation period of a driving roller that drives the endless belt.

8. The apparatus according to claim 1, wherein the sensor is provided along the moving direction of the peripheral surface of the endless belt such that a distance between the image forming unit and the sensor along the moving direction of the peripheral surface of the endless belt becomes a distance that minimizes, within the predetermined allowable range, a difference between the total variation associated with the reference color and the total variation associated with one of colors other than the reference color.

9. A method of controlling an image forming apparatus including an endless belt for formation of an image, a plurality of imaging forming units that are provided at positions different from each other along a moving direction of a peripheral surface of the endless belt and form images of different colors on the endless belt, and a sensor provided at a position on a downstream side relative to the plurality of image forming units along the moving direction of the peripheral surface of the endless belt, the method comprising:

forming a plurality of pattern images of different colors on the endless belt by using the plurality of image forming units, the plurality of pattern images of the different colors being used to calculate an amount of color deviation when a plurality of images of different colors are superimposed and formed on the endless belt;

detecting, using the sensor, the plurality of pattern images formed on the endless belt in the forming;

calculating the amount of color deviation from detection results on the plurality of pattern images which are obtained in the detecting; and correcting color deviation in accordance with the amount of color deviation calculated in the calculating, wherein in the forming, the plurality of pattern images are formed on the endless belt by using the plurality of image forming units at first intervals which reduce, to a predetermined allowable range, a total variation of a variation of a formation position where the pattern image is formed by the image forming unit on the endless belt with respect to an ideal position and a variation of a detection position where the sensor detects the pattern image with respect to an ideal position, the variations occurring when a moving speed of the peripheral surface of the endless belt fluctuates at a specific period, and wherein each of the first intervals is shorter than a distance between an image forming unit corresponding to a reference color and an image forming unit corresponding to each color other than the reference color.

10. The apparatus according to claim 1, wherein the specific period is longer than a period of a variation in a rotation speed of a driving roller that drives the endless belt.

11. The apparatus according to claim 1, wherein the ideal position is a position in a case where the moving speed of the peripheral surface of the endless belt does not fluctuate.

12. An image forming apparatus including an endless belt for formation of an image, a plurality of imaging forming units that are provided at positions different from each other along a moving direction of a peripheral surface of the endless belt and form images of different colors on the endless belt, and a sensor provided at a position on a downstream side relative to the plurality of image forming units along the moving direction of the peripheral surface of the endless belt, the apparatus comprising:

a pattern forming unit that forms a plurality of pattern images of different colors on the endless belt by using the plurality of image forming units, the plurality of pattern images of the different colors being used to calculate an amount of color deviation when a plurality of images of different colors are superimposed and formed on the endless belt;

a detection unit that detects, using the sensor, the plurality of pattern images formed on the endless belt by said pattern forming unit;

a calculation unit that calculates the amount of color deviation from detection results on the plurality of pattern images which are obtained by said detection unit; and a correction unit that corrects color deviation in accordance with the amount of color deviation calculated by said calculation unit, wherein said pattern forming unit forms the plurality of pattern images on the endless belt by using the plurality of image forming units at intervals which reduce, to a predetermined allowable range, a total variation of a variation of a formation position where the pattern image is formed by said image forming unit on the endless belt with respect to an ideal position and a variation of a detection position where the sensor detects the pattern image with respect to an ideal position, the variations occurring when a moving speed of the peripheral surface of the endless belt fluctuates at a specific period, and wherein the specific period is longer than a period of a variation in a rotation speed of a driving roller that drives the endless belt.

13. An image forming apparatus including an endless belt for formation of an image, a plurality of imaging forming units that are provided at positions different from each other along a moving direction of a peripheral surface of the endless belt and form images of different colors on the endless belt, and a sensor provided at a position on a downstream side relative to the plurality of image forming units along the moving direction of the peripheral surface of the endless belt, the apparatus comprising:

a pattern forming unit that forms a plurality of pattern images of different colors at predetermined intervals on the endless belt by using the plurality of image forming units, the plurality of pattern images of the different colors being used to calculate an amount of color deviation when a plurality of images of different colors are superimposed and formed on the endless belt;

a detection unit that detects, using the sensor, the plurality of pattern images formed on the endless belt by said pattern forming unit;

a calculation unit that calculates the amount of color deviation from detection results on the plurality of pattern images which are obtained by said detection unit; and a correction unit that corrects color deviation in accordance with the amount of color deviation calculated by said calculation unit, wherein said pattern forming unit forms the plurality of pattern images on the endless belt by using the plurality of image forming units at first intervals which reduce, to a predetermined allowable range, a total variation of a variation of a formation position where the pattern image is formed by the image forming unit on the endless belt with respect to an ideal position and a variation of a detection position where the sensor detects the pattern image with respect to an ideal position, the variations occurring when a moving speed of the peripheral surface of the endless belt fluctuates at a specific period, and wherein the first interval between the pattern image formed by an image forming unit corresponding to a reference color, of the plurality of image forming units, which is located on a most downstream side along the moving direction of the peripheral surface of the endless belt, and the pattern image formed by the image forming unit corresponding to each color other than the reference color is ½ a distance between the image forming unit corresponding to the reference color and the image forming unit corresponding to each color other than the reference color, when the specific period associated with a moving speed fluctuation of the peripheral surface of the endless belt is equal to a rotation period of the endless belt.

14. An image forming apparatus including an endless belt for formation of an image, a plurality of imaging forming units that are provided at positions different from each other along a moving direction of a peripheral surface of the endless belt and form images of different colors on the endless belt, and a sensor provided at a position on a downstream side relative to the plurality of image forming units along the moving direction of the peripheral surface of the endless belt, the apparatus comprising:

a pattern forming unit that forms a plurality of pattern images of different colors at predetermined intervals on the endless belt by using the plurality of image forming units, the plurality of pattern images of the different colors being used to calculate an amount of color deviation when a plurality of images of different colors are superimposed and formed on the endless belt;

a detection unit that detects, using the sensor, the plurality of pattern images formed on the endless belt by said pattern forming unit;

a calculation unit that calculates the amount of color deviation from detection results on the plurality of pattern images which are obtained by said detection unit; and a correction unit that corrects color deviation in accordance with the amount of color deviation calculated by said calculation unit, wherein said pattern forming unit forms the plurality of pattern images on the endless belt by using the plurality of image forming units at first intervals which reduce, to a predetermined allowable range, a total variation of a variation of a formation position where the pattern image is formed by the image forming unit on the endless belt with respect to an ideal position and a variation of a detection position where the sensor detects the pattern image with respect to an ideal position, the variations occurring when a moving speed of the peripheral surface of the endless belt fluctuates at a specific period, and wherein the sensor is provided along the moving direction of the peripheral surface of the endless belt such that a distance between the image forming unit and the sensor along the moving direction of the peripheral surface of the endless belt becomes a distance that minimizes, within the predetermined allowable range, a difference between the total variation associated with a reference color and the total variation associated with one of colors other than the reference color.

15. An image forming apparatus including an endless belt for formation of an image, a plurality of imaging forming units that are provided at positions different from each other along a moving direction of a peripheral surface of the endless belt and form images of different colors on the endless belt, and a sensor provided at a position on a downstream side relative to the plurality of image forming units along the moving direction of the peripheral surface of the endless belt, the apparatus comprising:

a pattern forming unit that forms a plurality of pattern images of different colors on the endless belt by using the plurality of image forming units, the plurality of pattern images of the different colors being used to calculate an amount of color deviation when a plurality of images of different colors are superimposed and formed on the endless belt;

a detection unit that detects, using the sensor, the plurality of pattern images formed on the endless belt by said pattern forming unit;

a calculation unit that calculates the amount of color deviation from detection results on the plurality of pattern images which are obtained by said detection unit; and a correction unit that corrects color deviation in accordance with the amount of color deviation calculated by said calculation unit, wherein said pattern forming unit forms the plurality of pattern images on the endless belt such that each of intervals of the plurality of pattern images becomes ½ a distance between an image forming unit corresponding to a reference color and an image forming unit corresponding to each color other than the reference color.

16. A method of controlling an image forming apparatus including an endless belt for formation of an image, a plurality of imaging forming units that are provided at positions different from each other along a moving direction of a peripheral surface of the endless belt and form images of different colors on the endless belt, and a sensor provided at a position on a downstream side relative to the plurality of image forming units along the moving direction of the peripheral surface of the endless belt, the method comprising:

forming a plurality of pattern images of different colors on the endless belt by using the plurality of image forming units, the plurality of pattern images of the different colors being used to calculate an amount of color deviation when a plurality of images of different colors are superimposed and formed on the endless belt;

detecting, using the sensor, the plurality of pattern images formed on the endless belt in the forming;

calculating the amount of color deviation from detection results on the plurality of pattern images which are obtained in the detecting; and correcting color deviation in accordance with the amount of color deviation calculated in the calculating, wherein in the forming, the plurality of pattern images are formed on the endless belt by using the plurality of image forming units at intervals which reduce, to a predetermined allowable range, a total variation of a variation of a formation position where the pattern image is formed by the image forming unit on the endless belt with respect to an ideal position and a variation of a detection position where the sensor detects the pattern image with respect to an ideal position, the variations occurring when a moving speed of the peripheral surface of the endless belt fluctuates at a specific period, and wherein the specific period is longer than a period of a variation in a rotation speed of a driving roller that drives the endless belt.

17. A method of controlling an image forming apparatus including an endless belt for formation of an image, a plurality of imaging forming units that are provided at positions different from each other along a moving direction of a peripheral surface of the endless belt and form images of different colors on the endless belt, and a sensor provided at a position on a downstream side relative to the plurality of image forming units along the moving direction of the peripheral surface of the endless belt, the method comprising:

forming a plurality of pattern images of different colors on the endless belt by using the plurality of image forming units, the plurality of pattern images of the different colors being used to calculate an amount of color deviation when a plurality of images of different colors are superimposed and formed on the endless belt;

detecting, using the sensor, the plurality of pattern images formed on the endless belt in the forming;

calculating the amount of color deviation from detection results on the plurality of pattern images which are obtained in the detecting; and correcting color deviation in accordance with the amount of color deviation calculated in the calculating, wherein in the forming, the plurality of pattern images are formed on the endless belt such that each of intervals of the plurality of pattern images becomes ½ a distance between an image forming unit corresponding to a reference color and an image forming unit corresponding to each color other than the reference color.

* * * * *